US006155554A

United States Patent [19]

Helm et al.

[11] Patent Number: 6,155,554

[45] Date of Patent: Dec. 5, 2000

[54] MULTIPLE ACTION SHOVEL FEED MECHANISM FOR STACKED SHEETS

[75] Inventors: Herbert W. Helm; Ronald G. Himmel, both of Hollidaysburg, Pa.; Hans Theo Heister, Ashford, United Kingdom

[73] Assignee: F. L. Smithe Machine Company, Inc., Duncansville, Pa.

[21] Appl. No.: 08/966,067

[22] Filed: Nov. 10, 1997

[51] Int. Cl.[7] ..... B65H 3/12

[52] U.S. Cl. ..... 271/94; 271/98; 271/99; 271/104; 271/105

[58] Field of Search ..... 271/94, 98, 99, 271/105, 104

[56] References Cited

U.S. PATENT DOCUMENTS

| | | | |
|---|---|---|---|
| 1,920,001 | 7/1933 | Chambers . | |
| 1,939,193 | 12/1933 | Winkler et al. | 271/29 |
| 2,241,474 | 5/1941 | Novick | 271/1 |
| 2,799,497 | 7/1957 | Novick | 271/2 |
| 2,845,264 | 7/1958 | Faeber | 270/54 |
| 2,954,224 | 9/1960 | Schneider et al. | 268/59 |
| 2,991,074 | 7/1961 | Saltz et al. | 271/29 |
| 3,015,484 | 1/1962 | Kistner et al. | 271/41 |
| 3,141,667 | 7/1964 | Novick | 271/74 |
| 3,160,081 | 12/1964 | Novick | 93/62 |
| 3,380,353 | 4/1968 | Mittermayer | 93/61 |
| 3,497,205 | 2/1970 | Harrison | 271/41 |
| 3,586,316 | 6/1971 | Ehlscheid | 271/29 |
| 3,599,970 | 8/1971 | Smithe | 271/29 |
| 3,625,505 | 12/1971 | Lense | 271/14 |
| 3,790,163 | 2/1974 | Helm | 271/165 |
| 3,998,449 | 12/1976 | Hornung | 271/112 |
| 4,013,283 | 3/1977 | Tress et al. | 271/14 |
| 4,320,893 | 3/1982 | Blumle | 271/94 |

*Primary Examiner*—David H. Bollinger
*Attorney, Agent, or Firm*—Price & Adams

[57] ABSTRACT

A stack of sheets or blanks are supported for individual high speed feeding from the bottom of the stack on a table positioned adjacent to a feed cylinder. An air blast from a pivotal nozzle deflects the leading edge of the bottom blank downwardly into engagement by suction force with the surface of the feed cylinder. Rotation of the feed cylinder separates the bottom blank from the stack. A plurality of rocker arms are then oscillated forwardly into the gap between the stack and the separated bottom blank. The rocker arms are independently, rotatably supported transverse to the leading edge of the stack. The position of the rocker arms is adjustable to support the stack as determined by the die cut configuration of the blanks. A fast cam actuates oscillation of centrally positioned rocker arms beneath the central portion of the stack leading edge with an accompanying blast of air between the bottom blank and the stack. Slow cams oscillate the laterally positioned rocker arms beneath the lateral portions of the stack leading edge with an accompanying blast of air between the bottom blank and the stack. The lateral rocker arms move after the centrally positioned rocker arms to ensure that the lateral edge portions of the stack remain stationary and do not sag into the path of the separated bottom blank and jam the feed operation. The independently supported rocker arms are laterally adjustable across the stack leading edge for efficient conversion of the feed operation from one style of blank to another.

20 Claims, 7 Drawing Sheets

MULTIPLE ACTION SHOVEL FEED MECHANISM FOR STACKED SHEETS

FIELD OF THE INVENTION

This invention relates to a sheet feeding method and apparatus and, more particularly, to a shovel feed mechanism for supporting a stack of blanks or sheets of a preselected configuration while the lowermost sheet is fed from the stack.

DESCRIPTION OF THE PRIOR ART

It is conventional practice in sheet feeding operations to feed sheets of material one by one from a stack supported by a rigid frame positioned adjacent to a sheet feeding mechanism, such as a feeder in an envelope making machine disclosed in U.S. Pat. Nos. 4,320,893; 3,599,970, 3,790,163 and 3,998,449. Feeding sheets from a stack is utilized for a wide variety of materials that include photographic film, corrugated blanks for making boxes, folded newspapers, tabulating cards, envelope blanks, and the like. The feeder devices are generally classified as top-sheet feeders and bottom-sheet feeders.

In a bottom-sheet feeder, the sheets are sequentially removed from the bottom of the stack by a feeder mechanism. The sheets are removed one by one and conveyed to other devices. This is the conventional practice in feeding envelope blanks from the bottom of a stack in an envelope making machine.

As disclosed is U.S. Pat. No. 3,599,970 envelope blanks are fed from the bottom of a stack onto a conveyor where the blanks are positioned in overlapping relation. The stack of envelope blanks rests on rotary supporting and separating discs. A feeder removes the blanks from the bottom of the stack by a sucker shaft of a feed cylinder which engages the lowermost or bottom blank in the stack. The blank is transferred from the surface of the feed cylinder to the surface of an adjacent rotating cylinder or to a series of conveyor belts as disclosed in U.S. Pat. Nos. 2,241,474; 2,954,224; 3,141,667; and 3,160,081. The feed cylinder is located adjacent to the bottom of the leading edge of the stack in a position to receive the bottom blank and move it downwardly away from the stack.

In combination with a feed cylinder, it is also known to mount a suction picker for oscillation through a path clear of the cylinder. The blanks are advanced along the path by the cylinder. One or more deflectors pivotally mounted relative to the front edge of the bottom of the stack move at an angle to the direction of picker travel to push each blank clear of the picker and into conformity with the surface of the cylinder.

To initiate separation of the lowermost blank from the stack, the picker is pivoted into position to engage the forward or leading edge of the lowermost blank. Upon application of suction or vacuum to the nozzle picker, the lowermost blank leading edge is bent or deflected away from the stack. The leading edge of the lowermost blank moves downwardly upon downward movement of the picker while the trailing edge of the blank remains fixed. Once the leading edge of the lowermost blank is separated from the stack, the stack must be supported above the lowermost blank.

One approach to ensuring separation of the bottom blank from the stack is to support the stack by counterrotating discs, as disclosed in U.S. Pat. Nos. 3,599,970 and 3,790,163, which include cutout portions for exposing during a portion of rotation of the discs the leading edge of the stack.

When the cutout portion of the discs is positioned beneath the stack, leading edge suction devices are swung into contact with the bottom blank and held there for a period of time to produce sufficient suction to grip the leading edge. When the suction device is swung downwardly, the leading edge of the sheet is drawn with it and completely separated from the bottom of the stack.

The suction force upon the leading edge acts for the period of time to permit the forward edge of the bottom blank to be engaged on the surface of a feed cylinder. Rotation of the feed cylinder pulls the bottom sheet from the stack. With this arrangement, the bottom sheet is not pulled from the stack until the leading edge is completely engaged and positively separated from the bottom of the stack, while the remainder of the stack is securely supported above the bottom sheet.

While the leading edge of the bottom sheet is engaged and separated from the bottom stack, the remaining sheets in the stack must be supported so that one or more sheets adjacent to the bottom stack are not displaced to interfere with or jam the bottom sheet as it is separated and fed from the stack. Thus, controlled separation of the bottom blank and stationary support of the remaining sheets in the stack is required to maintain sequential feeding of blanks one by one from the stack, particularly in high speed sheet feeders utilized in envelope making machines.

In a disc feeder, as described above, it is desirable to use the smallest size discs capable of supporting the stack as the bottom sheet is separated and fed from the stack. Support of a stack of sheets by rotating discs in an envelope making machine is readily accomplished for blanks which are symmetrical about their longitudinal centerline and have a relatively narrow and straight leading edge. These types of envelope blanks are typical for what are known as booklet or wallet style envelopes.

For larger size blanks, as encountered in making catalogsize envelopes and envelope blanks having an extended length die cut leading edge, separation of the leading edge of the blank is more difficult to control with rotary discs. Envelope blanks having a die cut leading edge include an intermediate portion that extends or leads the lateral portions of the leading edge. In other words, the lateral portions of the leading edge are recessed or displaced rearwardly from the intermediate portion of the leading edge. This blank configuration is found in making catalogsize envelopes having a center seam or a single side seam.

With a blank for forming an envelope with a center seam, the lateral portions of the leading edge are recessed or displaced rearwardly from an intermediate portion of the leading edge. The lateral recessed portions are normally symmetrical about the centerline of the envelope blank. In comparison, the blank for fabricating a single side seam envelope includes a leading edge which is offset from the centerline. One lateral side of the leading edge is short in length, typically one inch. The opposite lateral side has a length that approximates the length of the blank leading edge. The lateral sides are normally recessed or stepped from the intermediate or center leading edge by a distance between ¾ inch to 2 inches.

Rotary discs used in high speed feeding of stacked blanks are effective in feeding wallet or booklet style blanks and also blanks having a die cut configuration symmetrical about the centerline of the blank. The irregularly die cut blanks, such as the single side seam envelope blank, require adjustments to be made to the feeder to ensure that the bottom sheet is separated while the stacked blanks remain fixed.

With irregularly die cut blanks, the lateral portions of the blanks stacked above the bottom blank have a tendency to fall or deflect downwardly into contact with the bottom blank when the feed cylinder begins to remove the bottom sheet from the stack. This occurs when the lateral portions of the blank leading edge are not adequately supported in the stack.

U.S. Pat. No. 2,799,497 discloses adjusting a rotary disc feeder for an envelope making machine to convert from one blank style to another. The conversion requires an interruption in the feeding operation. In converting the blank feeder from a booklet style envelope blank having a symmetrical configuration with a straight leading edge to a single side seam style envelope blank having a nonsymmetrical configuration and a stepped leading edge, lateral adjustments must be made in the position of the rotary disks. Restrictions in the degree of lateral adjustment of the rotary discs limit the adjustment that can be made.

Another approach to supporting a stack of blanks for conversion from one style of envelope blank to another is provided by a shovel feed support mechanism. Two or more L-shaped rocker arms or "shovels" are positioned across the leading edge of the stacked blanks. The upper ends of the arms are clamped to a rotatable shaft. The shaft is rotated by a cam mechanism to oscillate the rocker arms in a forward stroke into engagement with the stack above the bottom blank after it has been separated from the stack followed by a rearward stroke after the bottom blank has been removed from the stack. For each feed cycle, the rocker arms oscillate forwardly, are held stationary, and then move rearwardly.

A single shaft supports the rocker arms oppositely of the leading edge of the stacked blanks. To accommodate variations in the size and die cut configuration of the blanks, the rocker arms are movable to selected locations along the length of the shaft. Accordingly, oscillation of the shaft moves all of the rocker arms in unison in forward and rearward strokes.

Examples of known shovel feeds used to support stacks of sheets or envelope blanks in envelope making machines are disclosed in U.S. Pat. Nos. 1,920,001; 3,380,353; 3,586,316 and 3,625,505. With these arrangements, the bottom of the stack is supported by a plurality of rocker arms and an oscillating sucker for separating the bottom blank. The stack supporting rocker arms move in timed relation with the sucker to penetrate into the gap formed by the sucker between the separated bottom blank and the lowermost blank in the stack.

The sheet feeding apparatus disclosed in U.S. Pat. No. 3,586,316 is particularly suited for feeding blanks cut for relatively wide envelopes. The lead flap extends a substantial length forwardly of side flaps. The side flaps extend laterally of the body portion of the blank. The stack is supported by a plate with the stack leading edge supported by three rocking suckers having suction nozzles contacting the bottom blank. The stack is also supported by a pair of shovel arms. All the shovel arms are mounted on a single shaft which is oscillated forwardly and rearwardly by a single cam mechanism.

U.S. Pat. No. 4,013,283 discloses a sheet feeding apparatus for separating single sheets from a stack by a pull-foot mounted on the shaft by a clamp screw. The shaft is actuated by a caming device so that in sequence with upward movement of a bottom roller, the lower end of the pull-foot is oscillated over the bottommost sheet. When the pull-foot is moved inwardly and the bottom roller is moved upwardly, the bottom surface of the pullfoot and the outer surface of the bottom roller pinch and positively engage a sheet disposed between them. The leading edge of the bottom sheet is separated from the stack by a suction cup connected to a suction line. Once the leading edge of the bottommost sheet is separated, the separator foot is shifted into position to support the remaining stack of sheets and maintain the bottommost sheet separated from the remaining stack.

U.S. Pat. No. 2,845,264 discloses a collator for producing bound books containing a plurality of folded sheets or "signatures". A plurality of booklets containing four or a multiple of four printed pages are stacked in a bin. The four page booklets are then fed one at a time from the bin onto a conveyor. The front or folded edge of the bottom signature is supported above the bin by a pin and the lower hook end of a pivotal finger. When a signature is to be withdrawn from the bin, the finger is pivoted to an operative position and the suction arm comes in contact with the lower front surface of the sheet. The sheet is pulled past the pin and delivered to jaws of a reciprocating feeder. When a bottom signature is pulled down, the finger pivots upwardly to enter the gap between the bottom signature and the stack above it and then lifts the pile.

In U.S. Pat. No. 3,015,484, IBM cards are fed at a high speed from the bottom of a stack of cards. A pair of rocker arms clamped to a shaft rock back and forth as the shaft is oscillated. Picker knives are carried on the end of the rocker arms. Movement of the shaft is actuated by cams and followers secured to a drive shaft. As the drive shaft rotates, the cams and followers move the shaft to oscillate the arms and picker knives in an arc to contact the bottom card and advance the card into feed rolls.

Other examples of shovel-action stack supports in sheet feeding operations are found in U.S. Pat. Nos. 1,939,193 and 3,497,205. With these devices, reciprocal movement of a rocker arm or shovel is controlled by movement of a cam follower on a cam plate which is mounted on a drive shaft. A single cam plate generates rocking or oscillating motion of the shaft upon which the cam follower is mounted and connected to the rocker arm. Any number of rocker arms can be mounted on the oscillating shaft. All the rocker arms move in unison to complete in each feed cycle a forward stroke and a rearward stroke. To accommodate different widths and configurations of sheet material, the rocker arms are slidable on the cam shaft. This facilitates adjustment of the feeder to convert from one configuration of sheet to another.

Even though it is known to adjust the position of the rocker arms along the leading edge or width of the stack, all the rocker arms oscillate in unison to engage and disengage the leading edge of the stack. This arrangement is efficient for blanks that have a uniform width but not for die cut blanks in which the leading edge is cut to form an intermediate portion and laterally extending portions displaced rearwardly from the intermediate portion. All the rocker arms move in unison. If the bottom blank is not sufficiently separated from the stack, the lateral rocker arms will not move into the gap between the stack and the bottom blank. The rocker arms will engage the bottom blank causing a jam. Also, the rocker arms may not be positioned to support the lateral portions that extend a considerable length from center of the leading edge.

The stack tends to sag or deflect downwardly at the lateral portions into the path of the bottom sheet as it is being separated from the stack. This can cause a number of problems that interrupt the feeding operation. For example, more than one sheet is pulled from the stack causing a paper jam on the surface of the feed cylinder or more than one sheet is fed at a time from the stack. Jamming in the feedline is particularly a problem in high speed sheet feeding operations. In order to clear a jam at the feeder, the sheet feeding operation must be interrupted.

Therefore, there is need in high speed sheet feeding operations and particularly in feeding large center seam and side seam envelope blanks for a stack support mechanism that maintains the stack supported above the bottom blank as the bottom blank is separated and fed from the stack.

SUMMARY OF THE INVENTION

In accordance with the present invention, there is provided sheet handling apparatus that includes a frame for supporting a stack of sheets with a leading edge of each sheet projecting forwardly of the frame. A plurality of arm members are positioned in spaced relation transversely of the stack of sheets. The arm members each have a lower end portion for supporting the bottom of the stack of sheets at the leading edge. The arm members are supported for independent pivotal movement to oscillate the lower end portions into and out of supporting relation with the stack of sheets. Drive means for actuating independent oscillating movement of the arm members in timed relation to each other moves the lower end portions in a preselected sequence into and out of supporting relation with the leading edge of the stack of sheets.

Further in accordance with the present invention, there is provided a method for handling a stack of sheets that includes the steps of supporting a plurality of individual sheets in a stack. The sheets are stacked with the leading edge of each sheet in alignment to form a leading edge of the stack. A plurality of support pads are positioned in underlying relation with the leading edge of the stack. The support pads are moved to preselected positions along the stack leading edge to support the stack. The support pads are oscillated into and out of underlying engagement with the stack at the leading edge to permit separation of the bottom sheet from the stack. The oscillating movement of the support pads is actuated in a preselected timed sequence with selected ones of the support pads engaging the stack before the other support pads are moved into engagement with the stack.

In addition, the present invention is directed to apparatus for supporting a stack of sheets that includes a support plate for supporting the stack of sheets to be fed individually from the stack. The support plate has a front edge portion for supporting the stack of sheets with a leading edge of each sheet projecting forwardly from the front edge portion. A feed cylinder is positioned beneath the leading edges of the stack of sheets. The feed cylinder has a surface for applying a suction force to the leading edge of the bottom sheet in the stack to engage the bottom sheet to the feed cylinder surface for separation from the stack. A plurality of pads are positioned oppositely of the support plate front edge portion in spaced relation across the leading edges of the sheets for supporting the stack of sheets. A plurality of arm members are connected to and extend upwardly from the rods. The arm members are each connected at an opposite end to one of a plurality of shafts extending transversely of the stack of sheets. The plurality of independently rotatable shafts are positioned in longitudinal alignment. The arm members are movable longitudinally on the shafts to locate the pads in preselected positions oppositely of the leading edges of the stacked sheets. The pads are moved by the arm members into and out of position supporting the stack of sheets upon rotation of the plurality of shafts. Each pad includes means for directing a timed blast of air at the stack to separate a bottom sheet in the stack from the remaining sheets in the stack to position the pads in supporting relation with the stack with the bottom sheet separated for removal from the stack. A drive shaft is mounted adjacent to the plurality of shafts. A plurality of cam mechanisms connect the drive shaft to the plurality of shafts respectively to transmit oscillating motion to the shafts for independent timed movement of the pads into and out of position supporting the stack of sheets.

Accordingly, a principal object of the present invention is to provide method and apparatus for feeding sheet material from the bottom a stack of sheets where the stack is supported as sheets are individually fed in sequence from the bottom of the stack.

Another object of the present invention is to provide in an envelope making machine a feeding mechanism for supporting envelope blanks having an irregular die cut configuration at the leading edge of each blank with the stack of blanks supported by rocker arms that are independently movable to engage in a timed sequence the bottom of the stack so that the stacked blanks do not interfere with the sheet feeding operation.

A further object of the present invention is to provide a multiple action shovel feed mechanism for supporting stacked blanks as the bottom blank in the stack is separated from the stack and fed to an envelope machine.

An additional object of the present invention is to provide a plurality of independently movable shovel feed supports for maintaining a stack of sheets in a fixed position while the lowermost sheet is removed from the stack.

These and other objects of the present invention will be more completely disclosed and described in the following specification, the accompanying drawings, and the appended claims.

DESCRIPTION OF THE PREFERRED EMBODIMENTS

Figure 1:
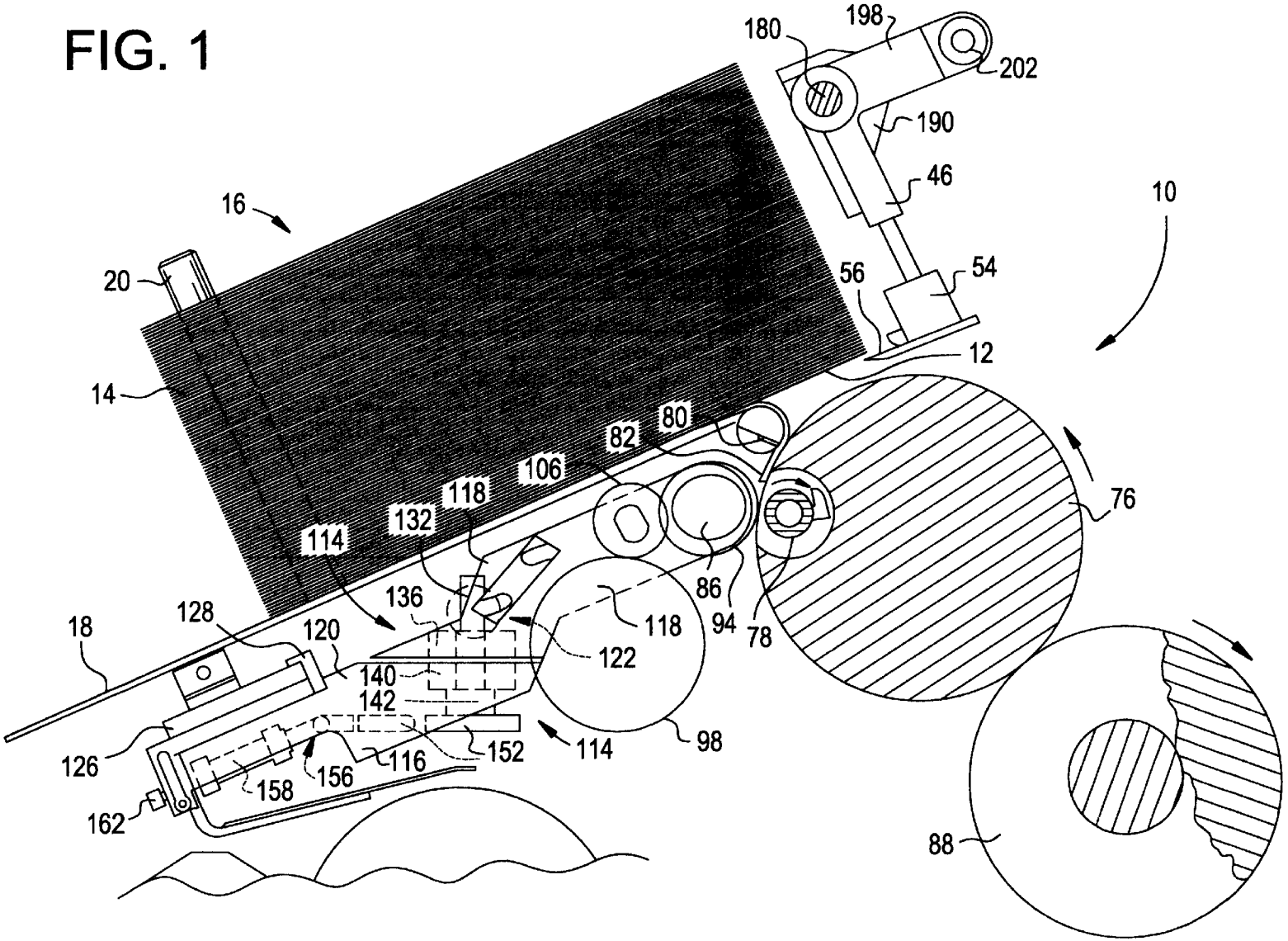
FIG. 1 is a schematic view in side elevation of a sheet feeding mechanism for an envelope making machine, illustrating a stack of envelope blanks supported by a plate with a shovel feed mechanism supporting a leading edge of the stack.
Figure 2:
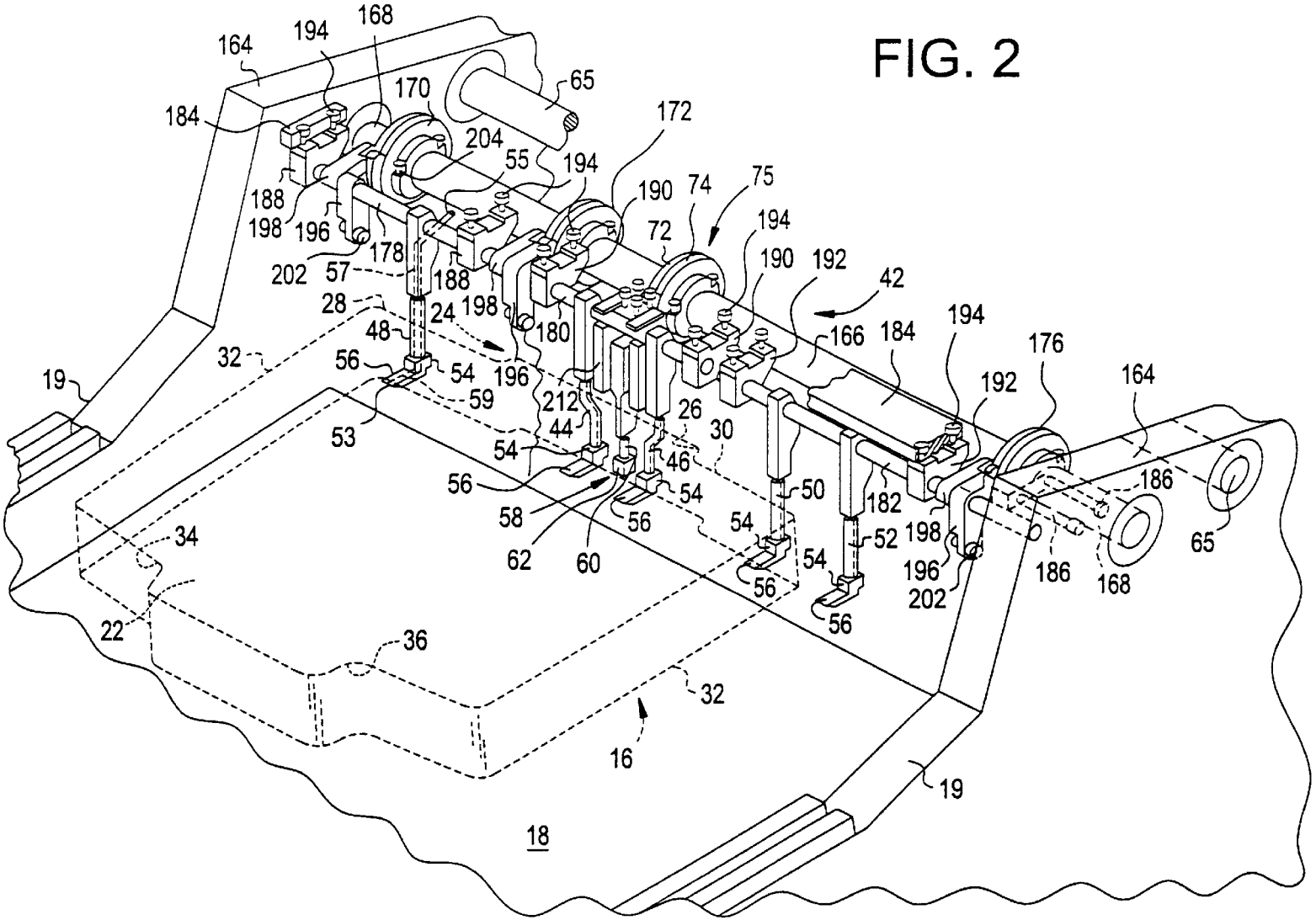
FIG. 2 is a fragmentary isometric view of the shovel feed mechanism shown in FIG. 1, illustrating a plurality of shovel arms independently movable into and out of contact with the leading edge of the bottom of the stack.

Referring to the drawings and particularly FIGS. 1 and 2, there is illustrated a sheet or blank feeding device generally designated by the numeral 10 operable to sequentially remove one by one the bottom blank 12 from a stack 16 of blanks 14. The feeding device 10 is preferably used to feed the blanks 14 from the stack 16 to an envelope making machine (not shown). It should also be understood that the sheet feeding device 10 is also operable to feed other types of sheet material, such as sheets to a printing press, photographic film, corrugated blanks for making boxes, folded newspapers, tabulating cards, and the like.

A stack support plate 18 is rigidly mounted to a frame 19 of the envelope machine to support the stack 16 of blanks 14. A pair of register rods 20, one of which is shown in FIG. 1 are secured to and extend upwardly from the surface of the support plate 18 to provide a register reference for the blanks 14 in the stack 16 during stacking and feeding of the blanks to the envelope machine or other working portions of the apparatus to which the blanks or sheets are fed.

As seen in FIG. 2, the stack 16 of blanks 14 is shown in phantom. Each of the blanks 14 in the stack 16 has a die cut configuration for converting a blank 14 into a folded envelope by an envelope making machine positioned downstream of the feeding device 10. Each of the blanks 14 forming the stack 16 in FIG. 2 has a configuration to form a wallet or booklet style envelope.

A rectangular bottom flap of a blank 14 forms an elongated front edge portion generally designated by the numeral 24 in FIG. 2. The front edge portion 24 is the leading edge of each blank 14 as it is fed from the bottom of the stack 16. The front or leading edge portion 24 has a die cut configuration formed by an intermediate or central portion 26 and a pair of side or lateral portions 28 and 30 extending laterally from both sides of the intermediate portion.

The lateral portions 28 and 30 are equal in length across the front edge portion 24. The lateral portions 28 and 30 are recessed or displaced rearwardly from the intermediate portion 26 of the leading edge 24. The intermediate portion 26 and the lateral portions 28 and 30 form the bottom flap of a booklet style envelope blank. Extending rearwardly from the leading edge portion 24 are side or end flaps 32.

Each blank 14 also includes recessed portions 34 and 36 between the seal flap 22 and the side flaps 32. The blank recessed portions 34 and 36 abut the vertical rods 20 to maintain the blanks in register as they are fed to the envelope machine. For clarity of illustration in FIG. 2, the register rods 20 are not shown. One register rod is shown in FIG. 1.

Figure 3:
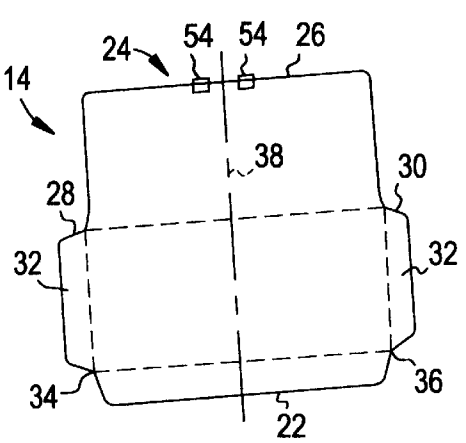
FIG. 3 is a schematic plan view of a stack of envelope blanks for forming booklet style envelopes, illustrating a straight leading edge of the blank and a pair of supports positioned equidistant of the centerline of the stack.
Figure 4:
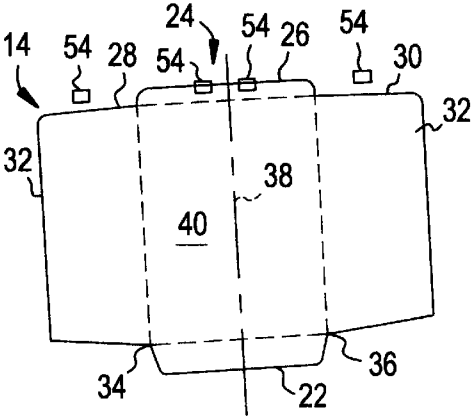
FIG. 4 is a view similar to FIG. 3 of a stack of envelope blanks for forming open end center seam style envelopes, illustrating the leading edge of the stack supported by a pair of supports and the opposite lateral edge portions supported by independently movable supports.
Figure 5:
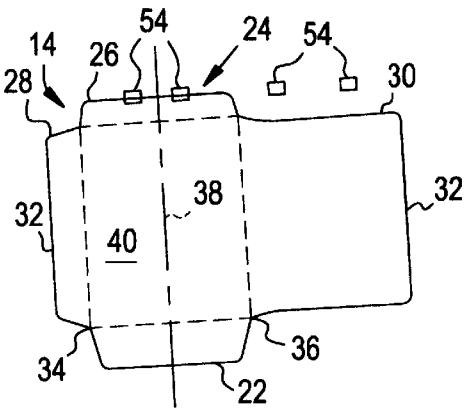
FIG. 5 is a view similar to FIGS. 3 and 4 of a stack of envelope blanks for forming open end side seam style envelopes, illustrating a pair of supports selectively positioned oppositely of one of the lateral edge portions and independently movable of the pair of supports positioned at the center of the leading edge.

Referring to FIGS. 3–5, there is illustrated other styles of envelope blanks that are stacked in the feeding device 10 for conversion into envelopes of a preselected configuration. The style of blank 14 shown in FIG. 3 corresponds substantially to the booklet style of blank 14 shown in FIG. 2 in which the blank configuration is symmetrical about a centerline 38 of the blank body portion 40. Accordingly, like numerals shown in FIG. 1 for the blank 14 are used to designate like parts for the blank 14 shown in FIG. 3.

The blank 14 shown in FIG. 3 is also used to form the wallet or booklet style envelope. In comparison with the booklet style blank 14 shown in FIG. 2, the blank in FIG. 3 includes a bottom flap 24 having an extended length. The bottom flap 24 forms the front or leading edge portion of the blank 14 in the direction of feed to the envelope machine.

The lateral edge portions 28 and 30 shown in FIG. 3 are substantially displaced rearwardly from the front edge portion 24. The width of the lateral portions 28 and 30 is shorter than the corresponding lateral portions 28 and 30 shown in FIG. 2. Also, the lateral portions 28 and 30 combine with the recessed portions 34 and 36 to form the side flaps 32. The recessed portions 34 and 36 merge with the seal flaps 22 which also form the trailing edge of the blank 14 in the direction of feed to the envelope machine.

FIGS. 4 and 5 illustrate blanks having a preselected die cut configuration for forming pocket-style envelopes. Pocket-style envelopes are conventionally used for shipping catalogs, brochures, advertising literature, and the like. The envelope blank shown in FIG. 4 has a die cut configuration which is also symmetrical about centerline 38 and is used to construct an open end center seam envelope.

The blank shown in FIG. 5 has a die cut configuration which is not symmetrical about centerline 38 and is used to form an open end side seam envelope. In comparison with the booklet and center seam style envelopes, the side seam style envelope has a body portion with a very long lateral portion 30 extending from the front edge intermediate portion 26. The lateral portion 28 on the opposite side of the intermediate portion 26 is very short in length.

While the configurations of the blanks 14 for center seam and side seam style envelopes have different die cut configurations in comparison with the booklet style blanks, they include the same elements identified by like numerals shown in FIG. 3. A notable feature of the open end center seam blank 14 shown in FIG. 4 is the equal length of the lateral portions 28 and 30 of the leading edge 24. Also, the lateral portions 28 and 30 are closely adjacent to the intermediate portion 26. In comparison, the booklet style blank shown in FIG. 3 includes lateral portions 28 and 30 substantially spaced rearwardly from the leading edge intermediate portion 26.

With the open end center seam style blank 14 of FIG. 4, the extended length of the lateral portions 28 and 30 requires additional support to prevent jamming of the feed operation by sagging of the stack 16 when the bottom blank is separated and removed from the stack. Thus, the stack support mechanism must be adjusted to provide additional support at the lateral portions 28 and 30 of the leading edge portion 24 which is not required for the booklet style blank 14 having lateral portions 28 and 30 relatively short in width.

The configuration of the open end side seam style blank 14 shown in FIG. 5 has a die cut configuration different from the blanks 14 shown in FIGS. 3 and 4. This style of blank requires still another support configuration to prevent the stack 16 from deflecting downwardly into the path of the bottom blanks as they are fed sequentially one after another to the envelope machine. Due to the wide variety of envelope blank styles that are used in the envelope making process, the blank feeding device 10 must be adjusted to accommodate conversion of the feeding device 10 from one style of blank to another without experiencing downtime in making the conversion.

The setup for supporting booklet style blanks in the stack 16 does not meet the needs for the other style of blanks. Therefore, in accordance with the present invention, the blank feeding device 10 is adjustable to efficiently accommodate each style of envelope blank that is used in the envelope making process. The adjustments to the feeding device 10 convert from one style of blank to another and are made without interrupting the feed operation for any significant period of time.

In accordance with the present invention, the blank feeding device 10 supports a wide range of blank configurations to ensure that each blank is separated and removed from the stack without jamming as the blanks are fed from the bottom of the stack. The stack is supported so that the lower blanks in the stack do not sag or deflect downwardly into the path of the bottom blank as it is separated and fed from the stack. This stack support is accomplished by a multiple action shovel feed mechanism generally designated by the numeral 42 in FIG. 2 and shown in greater detail in FIGS. 9 and 12.

As shown in FIG. 2, the multiple shovel feed mechanism 42 includes a plurality of independently movable rocker or shovel arm members 44, 46, 48, 50, and 52. The rocker arms are mounted for separate oscillating movement between a forward stroke engaging the bottom of the stack 16 and rearward stroke removed from contact with the bottom of the stack 16. Also, any number of rocker arms are utilized for independent oscillating movement into and out of contact with the bottom of the stack 16.

Support of the bottom of the stack 16 is accomplished by a foot or pad 54 which is pinned to the lowermost end of each rocker arm. Each pad 54 includes a substantially planar surface 56 that is moved on the forward stroke of each rocker arm member into contact with the leading edge portion of the stack 16.

The pad planar surface 56 is provided at its outer end opposite the stack with an air outlet 53 shown on rocker arm 48 in FIG. 2. The outlet 53 is connected to a source of air under pressure through an air line connection 55 extending rearwardly from the upper end of each rocker arm. For purposes of illustration, an air line connection 55 is shown only for rocker arm 48. It should be understood that the other rocker arms 44, 46, 50, and 52 also include an air line connection 55 and the following arrangement for supplying air flow to each outlet 53. The air line connection 55 communicates with an internal vertical passageway 57 that extends downwardly within the rocker arm 48 to the pad 54. An internal air passageway 59 within the pad 54 connects vertical passageway 57 to the air outlet 53. With this arrangement, a timed blast of air is delivered to the pad outlet 53 to separate a bottom sheet in the stack from the remaining sheets in the stack. In this manner, the pads 54 are positioned in supporting relation with the stack, and the bottom sheet is separated for removal from the stack.

The leading edge portion of the stack is formed by each of the blanks 14 positioned on the support plate 18 with the recessed portions 34 and 36 engaging the register rods 20. In this position, all of the blanks 14 are stacked in the same position on the support plate 18. Each blank leading edge portion 24 is positioned in overlying relation to form a collective leading edge of the stack 16, as shown in FIGS. 2–5.

The pad 54 on each rocker arm is moved in selected timed relation into and out of position where the pad surface 56 engages the bottom of the stack 16 above the bottom blank 12 as it is being separated and removed from the stack 16. During this movement, a timed blast of air is directed from the pad air outlet 53. The pads 54 are oscillated into and out of the gap between the bottom of the stack 16 and the bottom blank 12 being removed from the stack. The air blast only occurs when the pad 54 is moved into position to engage the bottom of the stack 16 above the bottom blank 12.

Prior to the rocker arms 44–52 moving into engagement to support the bottom of the stack 16, the bottom sheet or blank 12 is separated from the sheets above it by a separator mechanism generally designated by the numeral 58. The separator mechanism 58 also includes a rocking or oscillating arm 60 having at its lower end portion a pad 62 provided with an air nozzle 64, as shown in greater detail in FIG. 12. The air nozzle 64 communicates with an internal air passageway 61 connected to an external air line connection 63 of a compressed air source.

In a manner similar to the rocking movement of the arm members 44–52, the separator arm member 60 also oscillates between a forward position by a forward stroke and a rearward position by a rearward stroke. In the forward stroke of the separator arm 60, the pad 62 is positioned in supporting and underlying relation with the bottom blank 12 of the stack 16. In this position, the nozzle 64 is positioned oppositely of the bottom blank 12. A timed blast of air from the nozzle 64 deflects the leading edge 24 of the bottom blank 12 downwardly away from the blanks 14 in stack 16 above it. The pad 62 remains in contact with the bottom of the stack 16. The air blast to both the pad 62 of arm member 60 and each of the pads 54 of rocker arms 44–52 is generated by flow of compressed air to the respective air lines connections 53 and 63 through a conventional rotary-type air valve to a compressed air source. The details of the rotary air valve are beyond the scope of the present invention. The air valve (not shown) is mounted on a rotatable shaft 65, schematically illustrated in FIG. 2. The shaft 65 is journaled in the machine frame 19.

Figure 12:
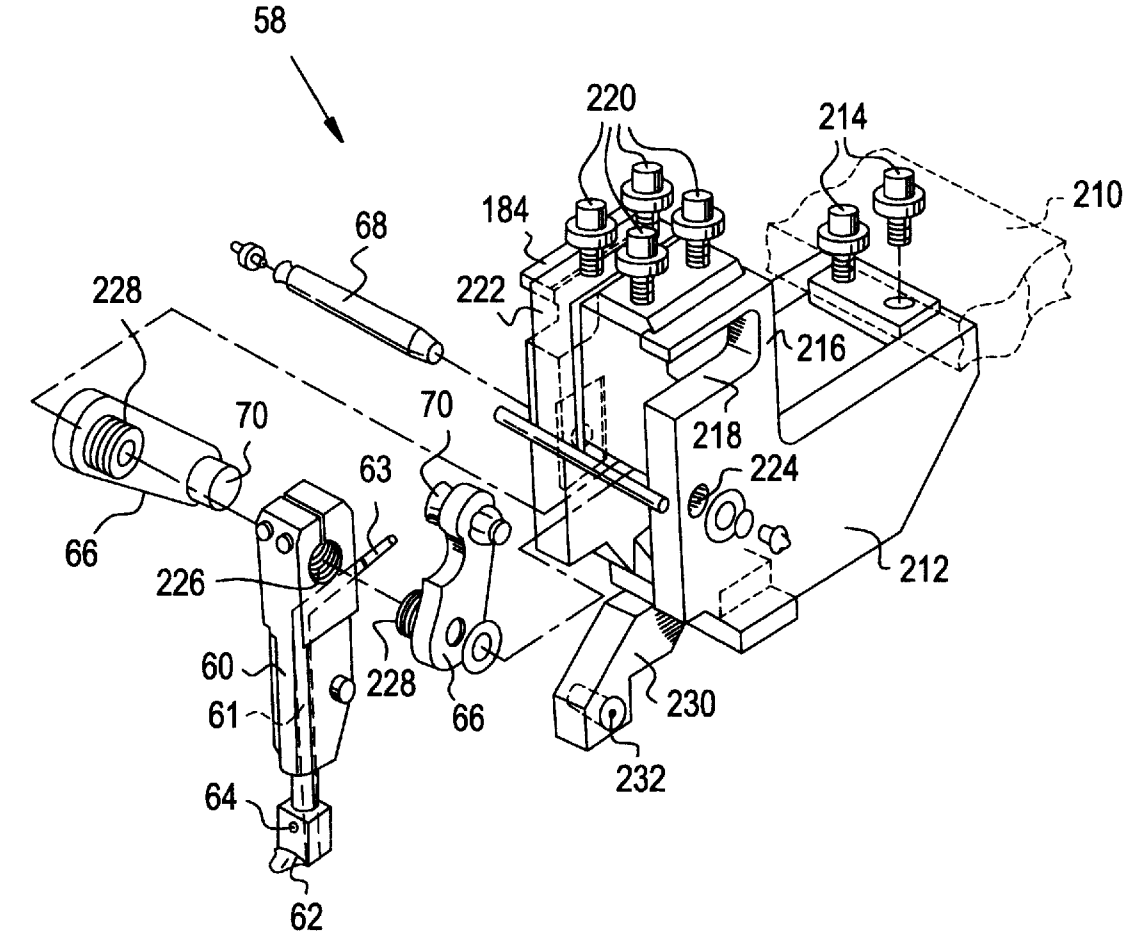
FIG. 12 is an exploded, isometric view of a separator assembly for separating the bottom blank from the stack, illustrating a cam actuated shovel arm having an air nozzle for directing a blast of air above the bottom blank in the stack.

The blast of air from the nozzle 64 is directed at a preselected time toward the center of the front or leading edge portion 24 of the bottom blank 12 to deflect it downwardly away frm the stack 16. The separator arm 60 as shown in FIG. 12 is connected by a pair of roller followers 66 to a support shaft 68. Rollers 70 on followers 66 follow cam surfaces 72 and 74 of a separator cam generally designated by the numeral 75 in FIG. 2. The rollers 70 follow the cam surfaces 72 and 74 to oscillate the separator pad 62 inwardly beneath the stack 16 of blanks 14 and outwardly away from the stack 16 in timed relation to movement of the rocker arms 44–52. Movement of the separator arm 60 is independent of movement of the rocker arms 44–52. In this manner, the weight of the stacked blanks is supported to facilitate removal of the bottom blank from the stack.

In accordance with the present invention, the oscillating movement of the rocker arms 44–52 is independently controlled to provide support for the stack 16 as determined by the style or configuration of envelope blank being fed to the envelope machine. For each style of envelope blank shown in FIGS. 3–5, the rocker arms 44–52 are selectively controlled in their forward and rearward oscillating movement to first advance into supporting relation with the intermediate portion 26 of the front edge 24 of the stacked blanks 14 followed by movement of rocker arms 44–52 into contact with the lateral portions 28 and 30 of the front edge 24.

The primary function of the rocker arms 44–52 is to support the stack of blanks 14 above the bottom blank 12 as it is being separated and removed from the stack 16. The bottom blank 12 is removed from the stack and transferred onto the surface of the feed cylinder 76. This takes place without jamming of the feed operation by the stack of blanks dropping into the path of the bottom blank 12 as it is removed from the stack.

Figure 6:
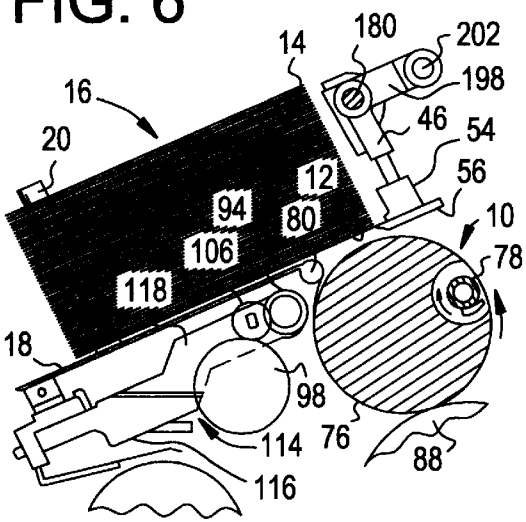
FIG. 6 is a fragmentary schematic view in side elevation of the blank feeding mechanism, illustrating a shovel arm pivoted through a forward stroke into engagement with the stack to support the stack as the bottom blank is separated from the stack and transferred to the surface of a feed cylinder.
Figure 7:
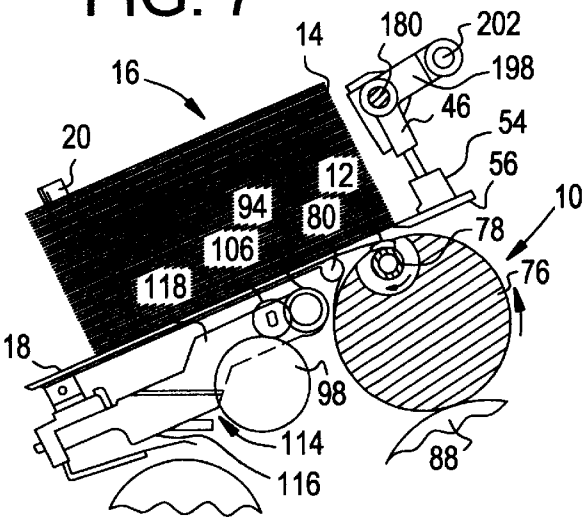
FIG. 7 is a view similar to FIG. 6, illustrating the feeding mechanism with shovel arm moved in a rearward stroke out of engagement with the stack as the leading edge of the bottom blank has been separated from the stack.
Figure 8:
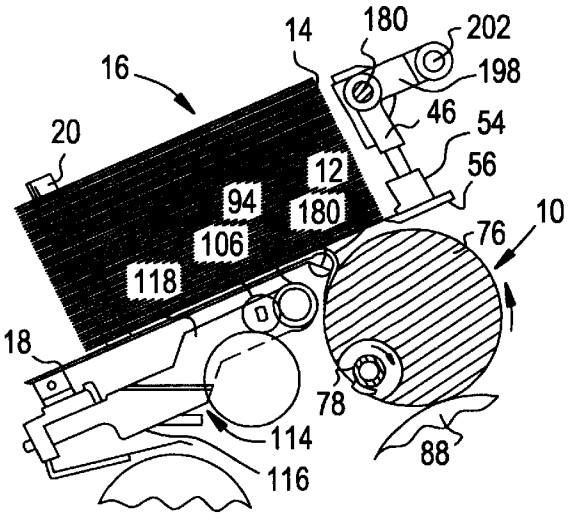
FIG. 8 is a view similar to FIGS. 6 and 7, illustrating the feeding mechanism reciprocated through a forward stroke into engagement with the leading edge of the stack to support the stack as the bottom blank is separated from the stack.

FIGS. 6–8 illustrate the stages of oscillation in a forward and rearward movement of the rocker arm 46 of the multiple action shovel feed mechanism 42 of the present invention. The separator arm 60 is not shown in FIGS. 6–8. The relative position of the rocker arm 60 with respect to the leading edge 24 of the bottom blank 12 is shown in FIG. 2. In this position of the separator arm 60, the shovel feed arm members 44–52 are also in supporting relation with the bottom of the stack 16.

In the position of the rocker arm 46 shown in FIG. 6, the bottom blank 12 has been separated and removed from the stack 16. The next bottom blank 12 is in position to be separated and removed from the stack 16. This is initiated by a rearward stroke of all of the rocker arms 44–52. At the rearward position of the rocker arms 44–52, the separator arm 60 is oscillated forward to position the pad 62 in supporting relation with the stack 16. In this position, a timed blast of air from nozzle 64 deflects the bottom blank 12 downwardly below the pad 62 and away from the stack 16. The air blast directs the leading edge of bottom blank 12 downwardly toward the surface of the feed cylinder 76. The separator arm 60 remains in supporting position with the stack 16.

On the surface of the feed cylinder 76 the blank leading edge 24 is engaged by a suction force, as shown in FIG. 7, from a sucker shaft 78 that is rotatably mounted on the surface of the feed cylinder 76. In a well known manner, the sucker shaft 78 is drivingly connected to a drive shaft (not shown) of the feed cylinder 76 which is rotatably supported in the machine frame 19. A suitable drive arrangement, such as a timing belt and pulley system, drivingly connects the sucker shaft 78 to the drive shaft of the feed cylinder 76. The gearing between sucker shaft 78 and drive shaft of the feed cylinder 76 is preferably set at a ratio of 3:1, whereby for each rotation of the feed cylinder, the sucker shaft 78 rotates three times on the surface of the cylinder 76.

The relative rotation between the sucker shaft 78 and the feed cylinder 76 positions the sucker shaft immediately beneath the bottom blank 12 as it is deflected downwardly by the air blast from the separator pad 62. The sucker shaft 78 has a plurality of protuberances extending radially therefrom and connected to a source of vacuum. The protuberances are preferably fabricated from a flexible material, such as urethane polymer, rubber or any other suitable material that is deformable and resilient. To ensure proper separation and removable of the lower blank 12, the protuberances of the sucker shaft 78 extend outwardly beyond the periphery of the feed cylinder 76 to a location adjacent the bottom of the stack 16 so that the underside of the bottom blank 12 is engaged to the protuberances, as shown in FIG. 7.

As the bottom blank 12 is deflected downwardly by the air blast from the separator pad 62, it is engaged by the sucker shaft 78. The blank 12 is then pulled from the stack 16 as the feed cylinder rotates in a counterclockwise direction as illustrated in FIG. 8. The sucker shaft 78 rotates in a clockwise direction or in a direction opposite to the direction of rotation of the feed cylinder 76.

Once the leading edge 24 of the bottom blank 12 is engaged by the sucker shaft 78, the rocker arms 44–52 move in a selected timed sequence into underlying relation with the bottom of the stack 16 above the bottom blank 12 as it is being removed from the 25 stack 16. The separator arm 60 remains beneath the stack 16 to support the weight of the stack as the rocker arms 44–52 are oscillated in a forward stroke.

The forward movement of the rocker arms 44–52 occurs in timed sequence. All of the rocker arms do not move in a forward stroke at the same time. The rocker arms 44 and 46 positioned oppositely of the central or intermediate portion 26 of the front edge portion 24 move first into engagement with the stack.

During the forward movement of the rocker arms 44 and 46, a blast of air is emitted from the respective pads 54. The air blast enters the stack between the bottom blank 12 and the stack 16. The air blast has two effects on the blanks 14. First, it assures separation of the bottom blank 12 from the stack 16 until the bottom blank 12 is engaged on the surface of the feed cylinder 76. Second, the air blast beneath the stack serves to add further support for the weight of the stack 16 above the bottom blank 14. This increases the efficiency in removing the bottom blank from the stack.

After the center rocker arms 44 and 46 are moved into stack supporting position, the rocker arms 48, 50, and 52 are moved forwardly into position. The rocker arms 48, 50 and 52 that are positioned oppositely of the lateral portions 28 and 30 at the front edge portion 24 of the stack 16. As the rocker arm 48, 50, and 52 are moved forwardly, an air blast is emitted from their pads 54 between blank 14 and stack 16.

As shown in FIG. 7, all of the rocker arms are positioned out of contact with the stack 16 during the initial separation of the bottom blank 12 from the stack 16. Then once the bottom blank is initially engaged by the sucker shaft 78 on the feed cylinder 76, the forward stroke of the respective rocker arms 44–52 is executed with the corresponding air blasts so that the stack along the entire leading edge is adequately supported so that the lateral portions in particular are not permitted to fall or sag downwardly into contact with the bottom blank 12 as it is being removed from the stack. If this should occur, more than one blank at a time would be removed from the stack causing jamming of the feeding device 10.

In FIG. 6, the multiple shovel feed mechanism 42 is shown in position supporting the stack 16 prior to separation of the bottom blank 12. Separation of the bottom blank 12 is initiated after the rocker arms 44–52 are moved to the rearward position. The pads 54 are removed from contact with the bottom blank 12, and the separator arm 60 is moved into position beneath the stack 16.

The separator pad 62 is positioned in contact with the bottom blank 12 so that an air blast from the nozzle 64 is directed at the bottom blank forward edge portion 24. The air blast deflects the edge portion 24 downwardly into engagement with the feed cylinder 76. The separator pad 62 remains in contact with the bottom of the stack 16 as the bottom blank 12 is deflected toward the feed cylinder 76. Once engaged by the sucker shaft 78, rotation of the feed cylinder 76 pulls the bottom blank 12 from the stack 16.

As the feed cylinder 76 rotates, the blank front edge portion 24 is engaged by the sucker shaft 78. The blank 12 is then transferred onto the surface of the feed cylinder 76. The suction force applied by the sucker shaft 78 is then interrupted. A plurality of vacuum ports (not shown) on the feed cylinder 76 apply a suction force along the entire front edge portion 24 of the bottom blank 12 as it is pulled from the stack 16 and transferred to the cylinder 76.

As the feed cylinder continues to rotate in a counterclockwise direction, the separated blank 12 is moved into contact with a guide roll 80 that is secured to and extends transversely across the forward edge of the stack support plate 18. As illustrated in FIG. 1 and in further detail in FIG. 10, an L-shaped guide plate 82 is bolted to the guide roll 80 to extend from the roll 80 IS tangent to and spaced from the surface of feed cylinder 76. With this arrangement, as the feed cylinder 76 rotates in a counter- clockwise direction with the bottom blank 12 secured to the surface of the cylinder, the blank leading edge portion 24 is guided around the roll 80 between the guide plate 82 and the surface of feed cylinder 76.

The guide plate 82 directs the blank 12 on the surface of the feed cylinder 76 into contact with the plurality of pull rolls 84 (FIG. 11) mounted on a driven shaft 86. The driven shaft 86 rotates the pull rolls 84 in a direction opposite to the direction of rotation of the feed cylinder 76 so that the blank 12 is conveyed from the stack 16. Prior to engagement of the blank 12 by the pull rolls 84, the blank 12 remains fixed beneath the stack 12 as the front edge portion 24 is bent downwardly by rotation of the sucker shaft 78.

In accordance with the present invention as the blank front edge portion 24 is bent downwardly, the rocker arms 44–52 are moved into position in a selected timed sequence with an accompanying blast of air from the pads 54 to support the bottom of the stack as the separator pad 62 also remains in contact with the bottom of the stack. This prevents the lowermost blanks 14 in the stack from being moved with the bottom blank 12 as it is being pulled from the stack 16. The air blast from the pads 54 maintains the stack 16 supported above and separated from the bottom blank. The air blast from the pads 54 comes in two stages, first from the center rocker arms 44 and 46 and then later from the lateral rocker arms 48, 50, and 52.

As the feed cylinder 76 continues to rotate in a counterclockwise direction, the separated blank 12 continues to bend downwardly away from the stack 16, as illustrated in FIGS. 7 and 8. As the blank front edge portion 24 is bent downwardly upon rotation of the feed cylinder 76, the guide roll 80 supports the blank.

The guide plate 82 directs the blank front edge portion 24 into the nip between the feed cylinder 76 and the pull rolls 84 on the driven shaft 86. When the bottom blank 12 is frictionally engaged by the pull rolls 84, the combined rotation of the feed cylinder 76 and pull rolls 84 positively removes the bottom blank 12 from beneath the stack 14. During this time, the stack 16 remains in register on the stack support plate 18. The stack 16 is stabilized by the sequential action of the shovel feed mechanism 42 as the bottom blank is being separated and removed from the stack.

The separated blank 12 remains on the surface of the feed cylinder 76 until the blank comes into contact with the surface of transfer cylinder 88. The transfer cylinder 88 also includes suction ports. At this point in the cycle, the suction is turned off in the ports of the feed cylinder 76 so that the blank is released from the feed cylinder 76 and transferred onto the surface of the transfer cylinder 88. From the transfer cylinder 88, the envelope blank 12 is conveyed to the envelope machine for conversion into a folded envelope.

The pull rolls 84 below the stack support plate 18 are nonrotatably secured in spaced relation to the driven shaft 86, as illustrated in detail in FIG. 11. The pull rolls 84 and hubs 90 and 92 are keyed to the shaft 86. The shaft 86 is supported in a movable frame 118. Each roll 84 includes a resilient peripheral surface for engaging the bottom blank 12 to pull it from the stack 16.

Figure 10:
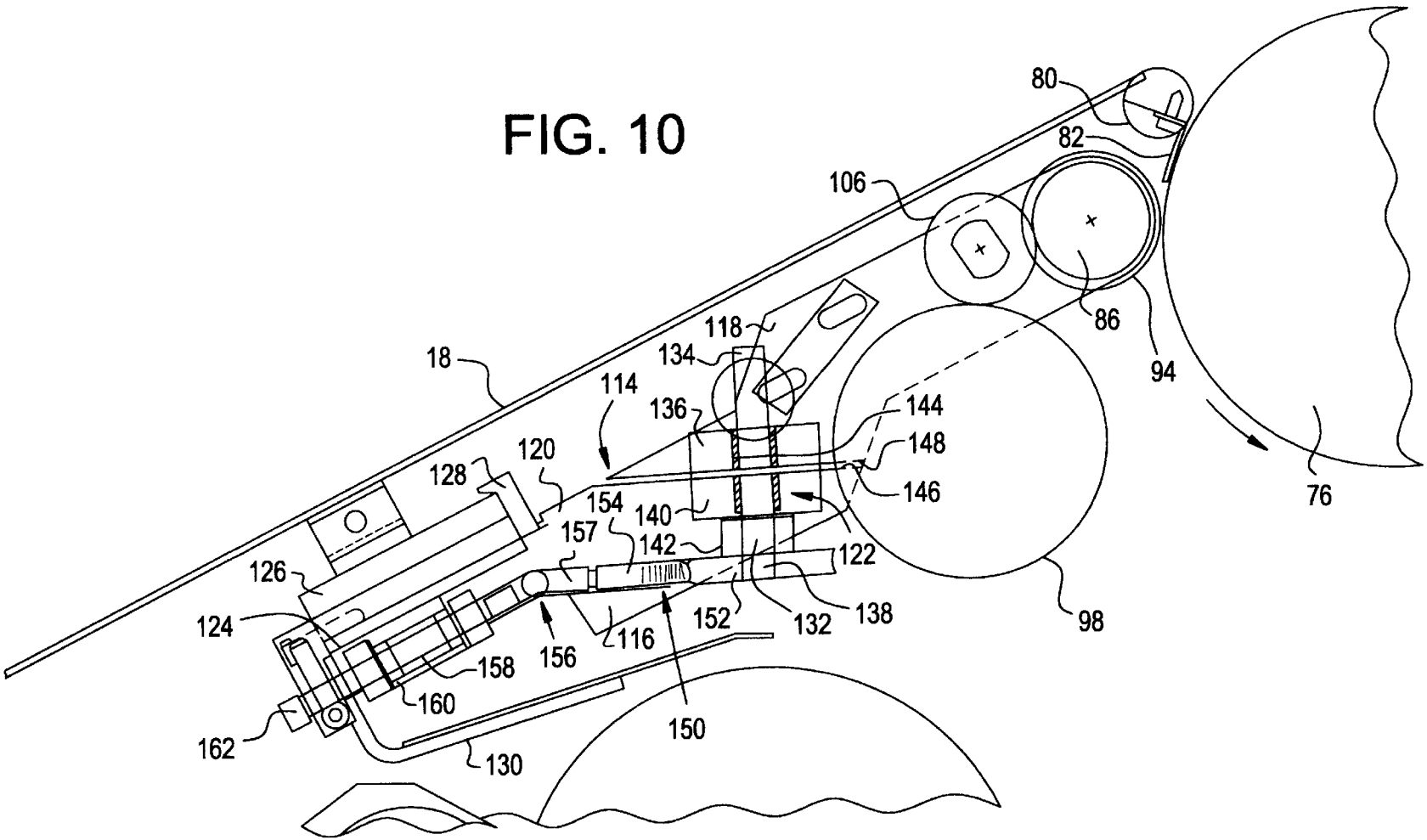
FIG. 10 is a fragmentary view in side elevation of the mechanism positioned below the stack support plate for adjusting the position of the pull rolls adjacent to the feed cylinder.
Figure 11:
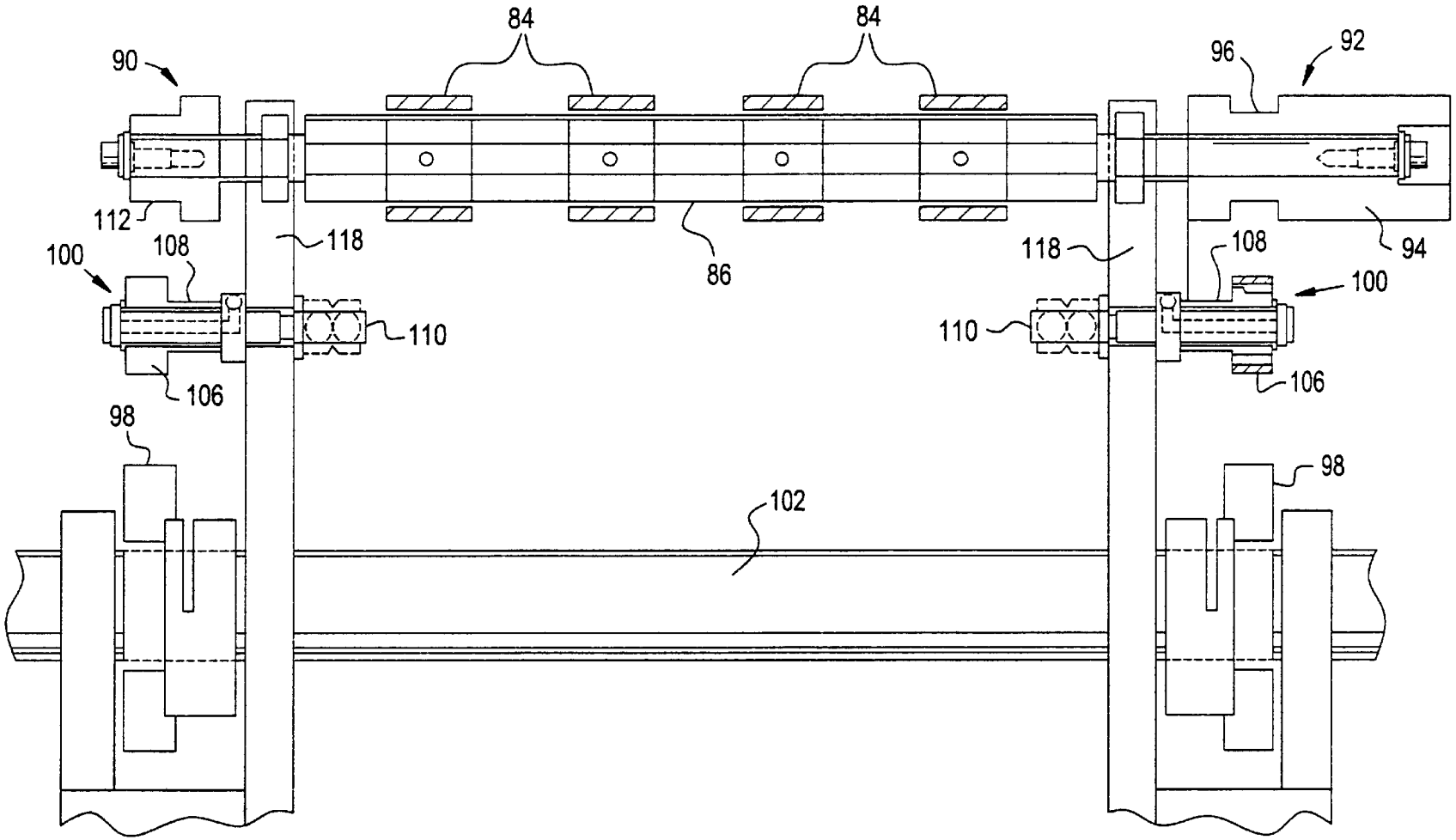
FIG. 11 is an exploded plan view of the driven pull rolls for removing the bottom blank from the stack, illustrating the drive connection for transmitting rotation to the pull rolls.

The hub 92 for the driven shaft 86 is illustrated in FIG. 11 and includes a cylinder 94 bolted to one end of the shaft 86. The cylinder 94 has a peripheral slot 96. Rotation is transmitted to the cylinder 94 from a drive roll 98 through an idler assembly generally designated by the numeral 100. The drive connection from the drive roll 98 through the idler assembly 100 to the hub 92 on the driven shaft 86 is schematically illustrated in FIGS. 1, 6–8 and 10. For clarity of illustration, the drive elements 92, 98, and 100 are shown in displaced position in FIG. 11 which is a "stretched view". In actual construction, the drive rolls 98 frictionally engage the surface of idler rolls 106 which are drivingly connected to the hubs 90 and 92 of shaft 86.

A drive shaft 102 is rotatably supported in frame 118 and is connected to the main drive of the envelope machine. The pair of drive rolls 98 are clamped to the ends of the drive shaft 102 outboard of a two part frame assembly generally designated by the numeral 114 in FIG. 10. The frame assembly 114 includes the frame component 118.

The idler assemblies 100, illustrated in FIG. 11, each include the idler roll 106 rotatably mounted by bearings 108 on a shaft 110 outboard of the frame component 118. The shafts 110 are nonrotatably mounted in the frame component 118 with the idler rolls 106 rotatable on the shafts 110. As illustrated in FIGS. 1 and 10, the surfaces of the drive rolls 98 frictionally engage the surfaces of the idler rolls 106. The idler roll 106 opposite the hub 92 is received in the slot 96 of hub 92. On the opposite end of the driven shaft 86, the idler roll 106 frictionally engages a reduced diameter portion 112 of the hub 90.

Rotation from the drive shaft 102 is transmitted from the drive rolls 98 through the idler rolls 106 to the hubs 90 and 92. Rotation of the hubs 90 and 92 rotates the driven shaft 86 and the pull rolls 84. Rotation of the pull rolls 84 in a direction opposite to rotation of the feed cylinder 76 removes the bottom blank 12 from the stack 16 once the bottom blank 12 enters the nip between the pull rolls 84 and the feed cylinder 76.

The gap or nip between the pull rolls 84 on the driven shaft 86 and the feed cylinder 76 is adjustable to accommodate the thickness of the blanks or sheets fed from the stack 16. The surface of the pull rolls 84 must be spaced a distance from the surface of the feed cylinder 76 to ensure that the blank when transferred to the surface of the feed cylinder 76 is frictionally engaged by the pull rolls 84. When the bottom blank 12 is completely pulled from the bottom of the stack 16, continued rotation of the feed cylinder 76 transfers the separated blank 12 to the surface of the transfer cylinder 88, shown in FIG. 1.

The relative position of the driven shaft 86 and the pull rolls 84 relative to the feed cylinder 76 is adjustable by provision of the spring biased support frame 114 illustrated in detail in FIG. 10. The frame 114 includes a two part structure that is spring biased to advance the driven shaft 86 toward and away from the surface of the feed cylinder 76. The frame 114 includes a fixed frame member 116 and a movable frame member 118. The movable frame member 118 is also illustrated in FIG. 11. The drive shaft 102 with the drive rolls 98 is supported by main frame 19. The idler rolls 106 and the driven shaft 86 with the pull rolls 84 are supported by the movable frame member 118.

As seen in FIG. 10, the fixed frame member 116 includes an upper end portion 120 connected by a combination adjustment screw and spring mechanism 122 to the movable frame 118 and a lower end portion 124 connected to a tie bar 126. The plate 18 is securely connected to the machine frame 19 illustrated in FIG. 2. The tie bar 126 is connected to the bottom of the support plate 18 extends transversely relative to the lower end portion 124 of the fixed frame member 116. A clamp 128 mounted on the frame lower end portion 124 is releasably engageable with the tie bar 126. In this manner, the fixed frame member 116 is releasably engageable with the bottom of the support plate 18. The clamp 128 is connected to the upper end portion 120 of the fixed frame member 116. A dust cover 130 is connected to and extends below the fixed frame member 116 in overlying relation with other components of the envelope machine.

The frame member 116 movably supports the frame member 118 to adjust the position of the driven shaft 86 to maintain the pull rolls 84 in frictional engagement with the blank on the surface of the feed cylinder 76. This is accomplished by provision of the combined adjustment screw and spring mechanism 122 shown in FIG. 10. An adjustment screw 132 movably connects the frame member 118 to the frame member 116. The adjustment screw 132 includes an upper threaded end portion 134 that engages a support block 136 secured to frame member 118. A lower end portion 138 of screw 132 is rotatably supported in blocks 140 and 142 which are secured to the fixed frame member 116. The screw lower end portion 138 is not threadedly engaged to the support blocks 140 and 142.

A spring 144 is positioned around the adjustment screw 132 within the aligned bores of support blocks 136 and 140. The spring 144 abuts at its lower end portion the support block 142 and abuts at its upper end portion the closed end of the threaded bore in the support block 136. With this arrangement, the spring 144 is captured within the aligned support blocks 136 and 140 around the screw 132. With the frame member 116 being fixed and the frame member 118 being movable, the compression spring 144 exerts a biasing force upon the frame member 118 to normally urge it away from the frame member 116. The threaded connection of the screw 132 to the movable frame member 118 restrains the biasing force of the spring 144.

Rotation of screw 132 in one direction permits the block 136 and frame member 118 to move away from the block 140 and frame member 116. The spring 144 extends in length from a compressed condition around the screw 132. This movement increases the distance between the opposed surfaces 146 and 148 of frame members 116 and 118 respectively. As the distance between the surfaces 146 and 148 of the frame members 116 and 118 increases, the pull rolls 84 are moved closer to the surface of the feed cylinder 76. Accordingly, rotation of the screw 132 in the opposite direction overcomes the spring force to compress the spring 144 and draw the opposing frame surfaces 146 and 148 closer together. This moves the pull rolls 84 away from the surface of the feed cylinder 76. In this manner, the spacing of the nip between the pull rolls 84 and the feed cylinder 76 is adjusted to ensure that the blank secured to the surface of the feed cylinder 76 is frictionally engaged by the rotating pull rolls 84.

The adjustment screw 132, as shown in FIG. 10, is rotated by a conventional worm drive mechanism generally designated by numeral 150. The mechanism 150 includes a worm wheel 152 keyed to the end of the adjustment screw 132 so that rotation of the wheel 152 rotates the screw 132. Rotation of the wheel 152 in one direction turns the screw 132 to move the frame members 116 and 118 apart and rotation of the wheel 152 in an opposite direction turns the screw 132 to move the frame members 116 and 118 toward each other. In this manner, the position of the pull rolls 84 is adjusted relative to the feed cylinder 76.

A worm shaft 154 drives the worm wheel 152 upon rotation of a linkage generally designated by the numeral 156 mounted on the lower end portion 124 of the fixed frame member 116. One end portion of the worm shaft 154 engages the periphery of the worm wheel 152. The opposite end of the worm shaft 154 is connected by a link arm 157 to the end of a shaft 158 that is rotatably journaled within a support block 160 mounted on the frame 116.

Rotation of an end portion 162 of shaft 158 in a preselected direction rotates the link arm 157, the worm shaft 154, and worm wheel 152 to rotate the adjustment screw 132 in a preselected direction to compress the spring 144 to move the frame members 116 and 118 together. This moves the pull rolls 84 away from the surface of the feed cylinder 76. Accordingly, rotation of shaft end portion 162 in the opposite direction allows the spring 144 to expand to move the frame member 118 away from the frame member 116 so that the pull rolls 84 toward the feed cylinder 76.

As above described, the spring biased support frame for the pull rolls 84 is mounted to the lower surface of the stack support plate 18. For clarity of illustration, the stack 16 of blanks is not shown in FIG. 10. The support plate 18, as shown in FIG. 2, is connected at its lateral portions to the machine frame 19. The machine frame 19 includes an upper end portion 164 that supports the multiple action shovel feed mechanism 42 at the forward edge of the stack 16.

The oscillating movement of the rocker arms 44–52 and the separator mechanism 58 in forward and rearward strokes is generated by rotation of a cam shaft 166 rotatably journaled at its end portions 168 in the frame upper end portion 164. The cam shaft 166 is drivingly connected to the main drive of the envelope machine. As shown in FIG. 2, a plurality of cam assemblies 75, 170, 172, and 176 are connected by pinch clamps to the shaft 166 to rotate therewith.

As illustrated in FIG. 2, a plurality of rods or arm members 178, 180, and 182 are independently supported in longitudinal alignment and parallel to the cam shaft 166. The arm members 178–182 are positioned between the cam shaft 166 and the leading edge of the stack 16. Each of the rods or arm members 178–182 is supported by a tie bar 184. The tie bar 184 extends between the frame upper end portions 164 and is connected thereto at its end portions by bolts 186.

The tie bar 184 is a unitary member. A plurality of pairs of brackets 188, 190, and 192 are connected to the lower surface of the tie bar 184 by bolts 194, as shown in FIG. 2. Each pair of brackets 188–192 is spaced a preselected distance apart. The end portions of the arm members 178–182 are rotatably journaled in the bracket pairs 188–192, respectively. With this arrangement, the rod or arm members 178–182 are independently supported oppositely of the stack of blanks 14.

The number of independently supported arm members is selective. With the present invention, at least two and preferably three rods, as shown in FIG. 2, are positioned oppositely of the stack 16. Each rod 178–182 supports one or more shovel or rocker arms which are in turn selectively positioned along the length of each rod. The number of support rods and shovel arms positioned thereon is selective based on the style of envelope blank fed from the stack 16.

Because of the plurality of support rods, shovel arms can be positioned at any location across the full width of the stack support plate 18. This permits the feeding device 10 to handle a wide variety of envelope blank styles without requiring time consuming adjustments to be made in the conversion of one style of blank to another. The shovel feed mechanism 42 is quickly and efficiently adjusted for conversion to support conventional booklet style blanks shown in FIG. 3 to more irregularly shaped blanks, such as open end center seam envelope blanks shown in FIG. 4, and open end side seam envelope blanks shown in FIG. 5.

As seen in FIG. 2, each rod 178–182 supports one or more shovel or rocker arms 44–52. With the embodiment shown in FIG. 2, a pair of rocker arms 44 and 46 are positioned on the rod 180 oppositely of the central or intermediate portion 26 of the front or leading edge portion 24 of each blank 14 in the stack 16. A single rocker arm 48 is positioned on the rod 178 oppositely of the lateral portion 28 of the front or leading edge portion 24 of the stacked blanks 14. On the other side, rod 182 is positioned oppositely of the lateral portion 30 of the front or leading portion 24 of the stacked blanks 14.

In accordance with the present invention, the number of shovel or rocker arms positioned on the respective rods 178-182 is selective. Also the number of rods positioned oppositely of the stack 16 is selective. In the embodiment shown in FIG. 2 three rods are utilized; however, two rods can be used. Four or more rods can be positioned between the frame 19 opposite of the stack 16. The number and location of rocker arms on the rods is also selective. Regardless of the number of rocker arm support rods that are positioned oppositely of the stack 16, each rod is independently supported for oscillating movement to generate forward and rearward strokes of the rocker arms.

Preferably, the rocker arm support rods 178–182 are independently oscillated by the cam assemblies 170, 172, and 176 mounted on the driven cam shaft 166. However, it should be understood that other mechanisms are utilized to rotate the rods that support the rocker arms 44–52 of the shovel feed mechanism 42. Other operative mechanisms include combination pulleys and gear belts, drive gears, servomotors, and the like.

Each cam mechanism 170, 172, and 176 shown in FIG. 2 is pinch clamped at a selected point on the cam shaft 166. The cam mechanism 172, which is positioned at approximately the center of the cam shaft 166 between the frame upper end portions 164, is shown in detail in FIG. 9. The other cam mechanisms 170 and 176 include the same components. Therefore, the following description of the cam mechanism 172 encompasses the corresponding components for the cam mechanisms 170 and 176.

Figure 9:
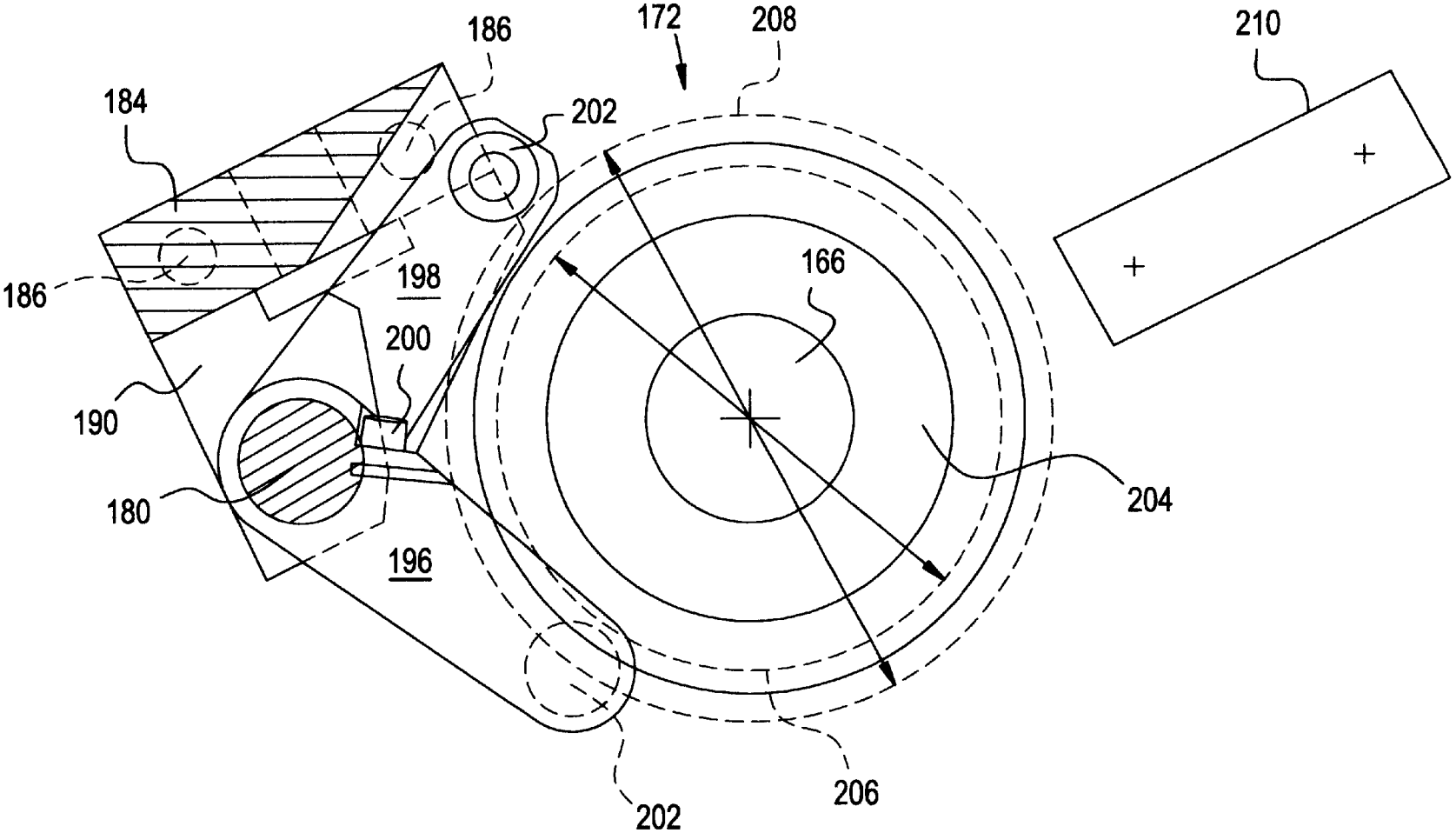
FIG. 9 is a schematic end view partially in section of one of the cam mechanisms for generating oscillating movement of one or more rocker arms, illustrating a pair of follower rollers on opposed cam surfaces.

As seen in FIG. 9, the rocker arm support rod 180 is rotatably supported at its end portions to the pair of brackets 190, one of which is shown in FIG. 9. The brackets 190 are in turn rigidly connected to the tie bar 184 that is connected by bolts 186 to the frame upper end portions 164. A pair of roller followers 196 and 198 are nonrotatably clamped to the rotatable rod 180 by bolts 200. With this arrangement, oscillating movement of the followers 196 and 198 generated by the cam mechanism 172 generates oscillation of the rod 180 in either the clockwise or counterclockwise direction.

As seen in FIG. 2, the roller followers 196 and 198 are positioned on the portion of the rod 180 that extends outboard of the bracket 190. For purposes of clarity of illustration, the followers 196 and 198 are shown positioned inboard of the bracket 190 in FIG. 9. It should also be understood that all the roller followers 196 and 198 may be selectively positioned along the length of the respective rods 178–182.

A roller 202 is rotatably mounted on the outer end of each follower 196 and 198. The rollers 202 are positioned on the cam mechanism 172, as shown in FIG. 9. Also, for purposes of illustration only in FIG. 2, the follower 196 mounted on each of the rods 178–182 is shown removed from contact with the respective cam mechanism and extending downwardly from the support rod. The operative position of all the roller followers 196 and 198 is in contact with the cam mechanism, as shown in FIG. 9. The position of the followers 196 in FIG. 2 is not the operative position. The operative position is shown in FIG. 9.

Each cam mechanism 170, 172, and 176 includes a radial cam 204 having a two part construction connected by bolts, as seen in FIG. 2, to the cam shaft 166 so that the cam mechanisms rotate with the cam shaft 166. The followers 196 and 198 are positioned oppositely of the cam 204 on the support rod. The cam 204 includes a pair of cam surfaces 206 and 208 as seen in FIG. 9. The surfaces 206 and 208 extend around the entire periphery of the cam 204 and are positioned in side by side relationship. The rollers 202 for each follower 196 and 198 ride on the cam surfaces 206 and 208 respectively. The cam surfaces 206 and 208 are of identical configuration but are displaced in phase relative to the cam shaft 166 by 180°.

Movement of the rollers 202 on the cam surfaces 206 and 208 move the followers 196 and 198 to generate oscillating, rotational movement of the associated rod. Rotation of the rods 178–182 oscillates the associated rocker arms 44–52 in a forward stroke and a rearward stroke for each cycle of rotation of the cam shaft 166.

Each of the cam surfaces 206 and 208 includes a rise portion, a dwell portion and a return portion. When the rollers 202 are in contact with the rise portion of the cam surfaces, the associated rod for the rocker arms is rotated in a counterclockwise direction to move the stack support pads 54 in a forward stroke into contact with the leading edge of the stack 16. Movement of the rollers 202 on the return portion of the cam surfaces generates rotation of the associated support rod in a counterclockwise direction to move the feet 54 in a rearward stroke out of engagement and clear of the stack 16.

FIGS. 6 and 8 illustrate the position of the rocker arm 46 in supporting relation with the leading edge of the stack 16 when the rollers 202 are in contact with the rise portion of the cam surfaces 206 and 208. FIG. 7 illustrates the position of the rocker arm foot 54 moved through a rearward stroke out of engagement and clear of the stack 16. The rearward stroke occurs during movement of the rollers 202 on the return portion of the cam surfaces 206 and 208. In one cycle of rotation of the cam shaft 166, each rocker arm 44–52 is moved from the position illustrated in FIG. 6 rearwardly to the position shown in FIG. 7 out of engagement with the stack 16 and then back to the position illustrated in FIG. 8 engaging the bottom of the stack 16.

As seen in FIG. 9, followers 196 and 198 engage the cam surfaces 206 and 208. Because the cam surfaces 206 and 208 are displaced 1800 relative to each other, a force is exerted by the rollers 202 on the cam surfaces 206 and 208 to stabilize the cam 204 and capture the followers 196 and 198 in position on the cam surfaces 206 and 208. This prevents the rollers 202 from becoming disengaged from the cam surfaces. For example, if follower 196 starts to move out of engagement with the cam surface 206, then the movement of the follower 198 on cam surface 208 restrains displacement of follower 196. By providing opposing cam surfaces 206 and 208, the rollers 202 for both cam followers 196 and 198 are maintained in contact with the cam surfaces to prevent an interruption in the oscillating movement of the rocker arms in the forward and rearward strokes for each cycle of rotation of the cam shaft 166.

The timing of the oscillating movement of the rocker arms in the forward and rearward strokes is determined by the radial position of the cam surfaces 206 and 208 on the cam shaft 166. Accordingly, to retard or advance the point during rotation of the cam shaft 166 when the rocker arm moves in a forward stroke, the radial position of the cam 204 on the shaft 166 is adjusted.

In accordance with the present invention, the cam mechanism 172 is provided with cam surfaces 206 and 208 having a configuration that generates oscillating movement of the rod 180 and associated rocker arms 44 and 46 faster than the oscillating movement generated by the cam mechanisms 170 and 176 for the rocker arms 48, 50, and 52 that support the lateral portions 28 and 30 of the leading edge of the stack 16. Consequently, the rocker arms 44 and 46 move into position to support the central intermediate portion 26 of the stack front edge portion 24 prior to movement of the rocker arms 48, 50, and 52 into position to support the lateral portions 28 and 30.

During forward movement of the rocker arms 44 and 46, the air blast from their pads 54 is applied before the air blast from rocker arms 48, 50, and 52. When the rocker arms 48, 50, and 52 move forward, a pressurized air stream is emitted from their pads 54. This timed sequence of air blasts between the bottom blank 14 and stack 16 is controlled by the rotary air valve positioned on rotatable shaft 65.

The rocker arms 44 and 46 are moved into position beneath the stack 16 after the separator mechanism 60 acts to deflect the leading edge intermediate portion 26 of the bottom blank 12. Once the blank 12 is engaged by suction on the feed cylinder 76 and is further bent downwardly as the cylinder 76 rotates, the path is clear for the rocker arms 48, 50, and 52 on rods 178 and 182 to move forwardly into supporting relation with the lateral portions 28 and 30 of the stack leading edge. Thus, for the die cut open end center seam and open end side seam blanks 14, shown in FIGS. 4 and 5, the laterally extending portions 28 and 30 of stack 16 are securely supported so that the stack does not drop into the path of the bottom blank 12 and cause a paper jam as the bottom blank 12 is separated and removed from the stack 16.

The cam 172 initiates the forward stroke of the rocker arms 44 and 46 before the other rocker arms and is, therefore, designated the "fast cam". The intermediate portion 26 of the stack 16 leads the lateral portions 28 and 30; therefore, as the bottom blank 12 is separated from the stack 16, the rocker arms 44 and 46 must move the foot surfaces 56 into engagement with the intermediate portion of the stack front edge 24. The air blast from rocker arms 44 and 46 is applied at this time. The rocker arms 48, 50, and 52 follow the rocker arms 44 and 46 during the interval in which the bottom blank 12 is clearly separated from the stack and is engaged by the feed cylinder sucker shaft 78 and bent downwardly away from the bottom of the stack 16. At this time in the cycle to prevent the blanks in the stack above the bottom blank from sagging downwardly, the lateral rocker arms are oscillated in a forward direction to move the foot surfaces 56 beneath the stack lateral portions 28 and 30. Also, an air blast is emitted from the pads 54 of the rocker arms 48, 50, and 52 at this time.

The movement of the lateral rocker arms 48, 50, and 52 and associated air blast is delayed relative to the movements and air blast of the centrally positioned rocker arms 44 and 46. Therefore, the cam mechanisms 170 and 176 are designated the "slow cams". The single fast cam 172 generates reciprocal movement of the centrally positioned rocker arms 44 and 46, and the slow cams 170 and 176 control the laterally positioned rocker arms 48, 50, and 52. The cam mechanism 75 independently controls the oscillating movement of the rocker arm 60 for the separator mechanism 58.

The provision of independently oscillating rocker arms 44–52 and associated independently oscillating rods 178–182 permits the feeding device 10 to handle a wide range of envelope styles that include the conventional wallet or booklet style shown in FIG. 3 and the die cut open end center seam style and open end side seam style shown in FIGS. 4 and 5. By independently supporting the rocker arms for oscillating movement, any number of rocker arms are positioned oppositely the stack 16 and at any location along the front edge portion 24. Three rods 178–182 are illustrated in FIG. 2, however, as indicated above, this number can reduced to two or increased to four or more rods. This is distinguished over the prior art devices that include only a single rod controlled by a single cam mechanism for all the rocker arms.

The rocker arms 44–52 are positioned on the rods 178–182 based on the die cut configuration of the blanks 14 in the stack 16. For example as seen in FIG. 3 for the conventional wallet or booklet style blank, the blank front edge 24 extends substantially the entire width of the blank with the lateral portions 28 and 30 substantially recessed from the intermediate portion 26 and are considerably shorter in width. For this shape of blank, only the fast cam 172 is required to generate reciprocal movement of the rocker arms 44 and 46 to move the feet 54 into supporting relation with the front edge 24. The slow cams 170 and 176 are not required to support the stack of booklet style blanks 14.

With the open end center seam style blank 14 shown in FIG. 4 both slow cams 170 and 176 are utilized to support the lateral portions 28 and 30 of the stack front edge 24 for the open end center seam style of blank. With this style, the body portion of the blank 14 is also concentric on the centerline 38. The lateral portions 28 and 30 are equally spaced from the centerline 38. Consequently, only a single rocker arm is required to move a foot 54 into supporting relation with each lateral portion 28 and 30.

The movement of the rocker arms for the lateral portions 28 and 30 and associated air blast is delayed until after the central rocker arms 44 and 46 and associated air blast are moved to engage the feet 54 beneath the intermediate portion 26. To convert the shovel feed mechanism 42 from the booklet style to the open end center seam style of blank, the followers 196 and 198 are set in position on the cam mechanism 170 and 176. In handling the booklet style blank, the slow cams 170 and 176 are not utilized.

When the open end side seam style blanks shown in FIG. 5 are fed to the envelope making machine, a different combination of cam mechanisms and rocker arm positions are selected. With the blank style shown in FIG. 5, the lateral portion 30 of the blank front edge 24 has a substantially extended length which exceeds the lengths of the intermediate portion 26 and the opposite lateral portion 28. To securely support this stack of blanks, the slow cam 170 is taken out of service and the fast cam 172 and the opposite slow cam 176 are utilized. Because of the substantial length of the lateral portion 30, the pair of rocker arms 50 and 52 are used to support the stack at the lateral portion 30.

The fast cam 172 initially moves the rocker arms 44 and 46 so that the feet 54 support the intermediate portion 26 as the bottom blank is pulled from the stack. After initial separation of the bottom blank 12, the slow cam 176 actuates the rocker arms 50 and 52 to move the feet 54 thereon into underlying relation with the lateral portion 30 at the front edge 24.

By providing a plurality of individually operable cams and corresponding rocker arms, the shovel feed mechanism 42 can be adjusted to handle a wide range of envelope styles and sizes. Consequently, the mechanism 42 is not out of service for a prolonged period of time to make the adjustments to convert the feeding device 10 from one blank style to another. The shovel mechanism 42 by virtue of its adjustability can handle booklet style blanks that have a front edge portion that varies in length from a minimum of five inches to a maximum of 16⅝ inches.

For open end center seam style blanks, as shown in FIG. 4, the intermediate portion 26 varies in length from 5 inches to 13 inches and the total length of the leading edge portion 24 including the lateral portions 28 and 30 varies from 10¾ inches to 28 inches. The offset of the lateral portions 28 and 30 from the intermediate portion 26 varies from ¾ inch to 2 inches. For the open end side seam style blank, as shown in FIG. 5, the intermediate portion 26 of the front edge 24 varies from 5 inches to 10½ inches in length. The total length across the front edge portion 24 including the intermediate portion 26 and lateral portions 28 and 30 varies from 10¾ inch to 21¾ inch. Also, the offset of the lateral portions 28 and 30 from the intermediate portion 26 varies from ¾ inch to 2 inches.

Thus, the shovel feed mechanism 42 of the present invention handles a wide variety of blank styles in which the dimensions of each style extend from a minimum configuration to a maximum configuration. This feature makes conversion of the shovel mechanism 42 very efficient without experiencing considerable downtime to modify the stack support for each style of blank.

Before the fast cam 172 actuates the centrally positioned rocker arms 44 and 46 to move the feet 54 into supporting relation with the stack leading edge, the separator mechanism 58 is actuated to move the pad 62 with the air nozzle 64 in position opposite the leading edge portion 24. Once in position, a blast of air from pad 62 against the stack separates the bottom blank 14 from the remainder of the blanks in the stack 16. The above described rotary air valve on shaft 65 also controls the timed flow of compressed air to the pad 62. During this cycle of operation, all of the rocker arms 44–52 remain stationary in a retracted position by movement of the cam followers 196 and 198 through the dwell portion of the cam surfaces 206 and 208. This cycle of motion of the rocker arms 44–52 is illustrated in FIG. 7 of the drawings. The separator mechanism 58 is not shown in FIG. 7.

The separator mechanism 58 is actuated by the separator cam 75 having a construction identical to the cam mechanisms 170, 172, and 176 described above. The separator mechanism 58, shown in detail in FIG. 12, is also connected to a tie bar 210 shown in FIGS. 9 and 12. The tie bar 210, similar to the tie bar 184 for the bracket pairs 188-192, is bolted at its end portions to the frame upper end portions 164. As shown in FIG. 9, the tie bar 210 for the separator mechanism 58 is positioned on the opposite side of the cam shaft 166 from the tie bar 184.

As shown in FIG. 12, a bracket 212 is connected by bolts 214 to the tie bar 210. An upper end portion 216 of bracket 212 includes a horizonal slot 218 through which extends the rod 180 (not shown in FIG. 12) that supports the rocker arms 44 and 46 on opposite sides of the separator rocker arm 60, as seen in FIG. 2. In addition, the tie bar 184 is connected to the bracket upper end portion 216 by bolts 220 to further rigidify the bracket 212 for pivotally supporting the rocker arm 60. An L-shaped clamp 222 on one of the bolts 220 extends downwardly in front of the slot 218 into contact with the lower portion of the bracket 212 to secure the rod 180 in the slot 218.

The separator rocker arm 60 is nonrotatably connected to the support shaft 68 that is rotatably retained within bores 224 of the bracket 212. The pair of roller followers 66 are also mounted on the support shaft 68 and are connected to the separator arm 60. The upper end of the rocker arm 60 includes a threaded bore 226 for receiving threaded stub shafts 228 that extend from the end of each follower 66. The support shaft 68 also extends through the stub shafts 228. With this arrangement, the followers 66 are connected to the upper end portion of the separator arm 60, and the separator arm 60 is nonrotatably connected to the support shaft 68.

The rollers 70 on the ends of the followers 66 are positioned on the cam surfaces 72 and 74 of the separator cam 75 shown in FIG. 2. The cam surfaces 72 and 74 actuate oscillating movement of the rocker arm 60. The cam surfaces 72 and 74 are also displaced in phase relative to each other by 180° so that the rollers 70 remain in contact with the cam surfaces 72 and 74.

As the cam shaft 166 rotates, the rollers 70 follow the cam surfaces 72 and 74 to generate oscillating, rotational movement of the shaft 68 through each cycle of rotation of the cam shaft 166. In a first portion of the cycle during which the rollers 70 engage If the rise portion of the respective cam surfaces 72 and 74, the shaft 68 is oscillated to generate a forward stroke of the separator rocker arm 60 into contact with the leading edge of the stack. At this time, a blast of air is emitted from pad 62. Movement of the rollers 70 on the cam surfaces 72 and 74 during the rise portion rotates the followers 66 to rotate the shaft 68 and move the separator arm 60 through a forward stroke.

During the dwell portion, the separator arm 60 remains stationary with the pad 62 in contact with the leading edge of the stack. The air blast from the nozzle 64 is then directed upon the bottom blank 12 to deflect it downwardly away from the stack 16. The bottom blank 12 moves downwardly out of contact with the pad 62. The pad 62 remains in contact with the bottom of the stack 16 to also support the stack 16 as the bottom blank 12 is separated therefrom.

As the bottom blank leading edge is deflected downwardly and gripped by the feed cylinder 76, the rocker arms 44–52 are sequentially oscillated in timed relation in a forward stroke to move the feet 54 in supporting relation with the leading edge of the stack with an accompanying air blast from their pads 54. The fast cam 172 initiates the forward stroke of the rocker arms 44 and 46 followed by actuation of the slow cams 170 and 176, as needed, to move the rocker arms 48, 50, and 52 into position with an accompanying air blast from their pads 54 beneath the stack leading edge lateral portions 28 and 30.

For a period of time during the dwell period, all of the 65 rocker arms remain stationary in supporting relation with the stack. Once the bottom blank 12 has been engaged to the surface of the feed cylinder 76 along the entire forward edge portion 24 including the lateral portions 28 and 30, the cam rollers move on the return phase of the cam surfaces to pivot the rocker arms through a rearward stroke removed from contact with the stack 16.

As seen in FIGS. 3–5, the fast cam 172 moves the feet 54 into position under the stack on opposite sides of the blank centerline 38. During this period of time, the pad 62 of the separator arm 60 also supports the front edge of the stack. The pad 62 remains in position under the stack after the blast of air from nozzle 62 has been interrupted.

As shown in FIG. 12, the bracket 212 includes a forwardly extending arm 230. An air manifold 232 is positioned in the arm 230 and is connected by an airline (not shown) to the nozzle 64 retained in the pad 62. In the position shown in FIG. 2, the outlet of the nozzle 64 projects toward the bottom of the stack 16 so that the air stream from the nozzle is directed upon the bottom blank 12. The bottom blank 12 is forced downwardly away from the stack 16 forming a gap between the bottom blank 12 and the stack 16. During the period of time the air blast acts on the bottom blank 12, all of the rocker arms are maintained out of contact with the stack 16, as shown in FIG. 6.

When the bottom blank 12 front edge portion 24 is deflected downwardly into contact with the feed cylinder 76, the fast cam 172 is actuated to oscillate the rocker arms 44 and 46 in a forward i5 stroke to move the feet 54 into the gap between the bottom blank 12 and the stack 16. The blank 12 is deflected into contact with the sucker shaft 78 on the cylinder 76. Rotation of the shaft 78 and cylinder 76 pulls the blank 12 from the stack 16, and the stacked blanks remain stationary on the plate 18. As the bottom blank advances downwardly, the slow cams 170 and 176 are actuated to oscillate selected ones of the rocker arms 48, 50, and 52 into supporting position beneath the front edge lateral portions 28 and 30 of the stack 24. Thus, the lateral portions of the stack are prevented from falling into the path of the bottom blank 12 as it is being separated and fed from the stack.

After the bottom blank 12 has been separated from the stack 16, the cams 170, 172, and 176 and the separator cam 74 actuate the rocker arms to move in a rearward stroke out of contact with the blank. Thereafter, the separator rocker arm 60 is oscillated forwardly to a apply a blast of air to separate the next bottom blank 12 from the stack.

Regardless of the style of blank 14 in the stack 16, the shovel feed mechanism 42 is adjustable to ensure that the stack is supported to provide uninterrupted feed of the bottom blank 12 from the stack 16. The rocker arms and associated shovel feet are selectively positioned across the front of the stack and independently operated to engage the stack at selected intervals. The stack is securely supported particularly for large die cut blanks to prevent jamming of blanks in high speed blank feeding operations.

According to the provisions of the patent statutes, we have explained the principle, preferred construction, and mode of operation of our invention and have illustrated and described what we now consider to represent its best embodiments. However, it should be understood that within the scope of the pended claims, the inventions may be practiced otherwise than as specifically illustrated and described.

We claim:

1. Sheet handling apparatus comprising, a frame for supporting a stack of sheets with a leading edge of each sheet projecting forwardly of said frame, a plurality of arm members positioned in spaced relation transversely of the stack of sheets, said arm members each having a lower end portion for supporting the bottom of the stack of sheets at the leading edge, said arm members being supported for independent pivotal movement to oscillate said lower end portions into and out of supporting relation with the stack of sheets, and drive means for actuating independent oscillating movement of said arm members in timed relation to each other to move said lower end portions in a preselected sequence into and out of supporting relation with the leading edge of the stack of sheets.

2. A method for handling a stack of sheets comprising the steps of, supporting a plurality of individual sheets in a stack, stacking the sheets with the leading edge of each sheet in alignment to form a leading edge of the stack, positioning a plurality of support pads in underlying relation with the leading edge of the stack, moving the support pads to preselected positions along the stack leading edge to support the stack, oscillating the support pads into and out of underlying engagement with the stack at the leading edge to permit separation of the bottom sheet from the stack, and actuating oscillating movement of the support pads in a preselected timed sequence with selected ones of the support pads engaging the stack before the other pads are moved into engagement with the stack.

3. Apparatus for supporting a stack of sheets comprising, a support plate for supporting a stack of sheets to be fed individually from the stack, said support plate having a front edge portion for supporting the stack of sheets with a leading edge of each sheet projecting forwardly from said front edge portion, a feed cylinder positioned beneath the leading edge of the stack of sheets, said feed cylinder having a surface for applying a suction force to the leading edge of the bottom sheet in the stack to engage the bottom sheet to said feed cylinder surface for separation from the stack, a plurality of pads positioned oppositely of said support plate front edge portion in spaced relation across the leading edges of the sheets for supporting the stack of sheets, a plurality of arm members connected to and extending upwardly from said pads, said arm members each being connected at an opposite end to one of a plurality of shafts extending transversely of the stack of sheets, said plurality of shafts being independently rotatably supported in longitudinal alignment, said arm members being movable longitudinally on said shafts to preselected positions for locating said pads in preselected positions oppositely of the leading edge of the stacked sheets, said pads being movable with said arm members into and out of position supporting the stack of sheets upon rotation of said plurality of shafts, said pads each including means for directing a timed blast of air at the stack to separate a bottom sheet in the stack from the remaining sheets in the stack to position said pads in supporting relation with the stack with the bottom sheet separated from the stack, a drive shaft mounted adjacent to said plurality of shafts, and a plurality of cam mechanisms connecting said drive shaft to said plurality of shafts respectfully to transmit rotation to said shafts for independent timed movement of said pads into and out of position supporting the stack of sheets.

4. Sheet handling apparatus as set fourth in claim 1 which includes:

a plurality of rods independently supported in longitudinal alignment by said frame, said rods positioned in end to end relation transversely a preselected distance from the leading edge of the stacks of sheets, and said arm members being pivotally mounted on said rods and movable to preselected positions along the length thereof to locate said arm members lower end portion at desired positioned to support the leading edge of the stack of sheets.

5. Sheet handling apparatus as set forth in claim 1 which includes:

means for independently supporting said arm members in axial alignment on said frame, and a cam mechanism supported by said frame and connected to said arm members for generating in a preselected timed sequence oscillating movement of said arm members lower end portions into and out of supporting relation with the stack of sheets.

6. Sheet handling apparatus as set forth in claim 5 in which:

a first group of said arm members are positioned centrally of the stack of sheets and a second group of said arm members are positioned laterally of the center of the stack of sheets, said cam mechanism first moves said first group into position to support a central portion of the stack of sheets followed by movement of said second group into position to support a lateral portion of the stack of sheets.

7. Sheet handling apparatus as set forth in claim 1 which includes:

a cam shaft rotatably journaled in said frame, said drive means drivingly connected to said cam shaft, said arm members rotatably supported between said cam shaft and the stack of sheets for movement toward and away from the stack, and a plurality of cam assemblies mounted on said cam shaft at selected points along the length thereof and engaged to said arm members for independently oscillating said arm members to move said lower end portions into and out of supporting relation with the stack of sheets at selected points on the leading edge of the stack.

8. Sheet handling apparatus as set forth in claim 7 which includes:

said cam assemblies include a first cam positioned on said cam shaft oppositely an intermediate portion of the stack and a second cam positioned on said cam shaft oppositely a lateral portion of the stack, said first cam oscillating one of said arm members to move said lower end portion thereof into and out of supporting contact with the intermediate portion of the stack leading edge, and said second cam oscillating a second of said arm members after said first arm members to move said lower end portion thereof into and out of supporting contact with the lateral portion of the stack leading edge.

9. Sheet handling apparatus as set forth in claim 8 which includes:

said one arm member is movable transversely of the stack of sheets to a selected location opposite the intermediate portion of the stack leading edge, and said second arm member is movable transversely of the stack of sheets to a selected location opposite the lateral portion of the stack leading edge.

10. Sheet handling apparatus as set forth in claim 1 which includes:

a first of said arm members positioned oppositely a central portion of the stack of sheets, a second of said arm members positioned oppositely a lateral portion of the stack of sheets, and said first arm member oscillated toward the stack of sheets faster than said second arm member is oscillated toward the stack of sheets so that said first arm member lower end portion moves into supporting relation with the intermediate portion of the stack of sheets faster than the second arm member lower end portion of the stack of sheets.

11. Sheet handling apparatus as set forth in claim 1 which includes:

said lower end portion of each of said arm members has an outer end with an air inlet positioned oppositely of the stack of sheets, and said air outlet connected to a compressed air source for delivering a timed blast of compressed air through said outlet to the bottom of the stack of sheets to separate a bottom sheet in the stack from the remaining sheets in the stack for movement of said arm members into supporting relation with the stack as the bottom sheet is separated from the stack.

12. Sheet handling apparatus as set forth in claim 1 which includes:

a separator arm supported oppositely of the stack of sheets adjacent to said arm members for oscillating movement between forward and rearward positioned relative to the stack of sheets, a pad provided with an air nozzle at a lower end of said separator arm, and said air nozzle connected to a compressed air source for directing a timed blast of compressed air at the leading edge of the bottom sheet in the stack to deflect the bottom sheet downwardly away from the remaining sheets in the stack while said pad remains in contact with the bottom of the stack.

13. Sheet handling apparatus as set forth in claim 12 which includes:

means connected to said separator arm for oscillating said pads inwardly beneath the stack and outwardly away from the stack in timed relation to movement of said arm members.

14. A method for handling a stack of sheets as set forth in claim 2 which includes:

supporting the support pads for oscillating movement toward and away from the stack along a common longitudinal axis, and selectively moving the support pads longitudinally to a plurality of desired locations along the length of the stack leading edge.

15. A method for handling a stack of sheets as set forth in claim 2 which includes:

directing a blast of compressed air toward the bottom sheet in the stack to deflect the bottom sheet downwardly away from the remaining sheets in the stack, and oscillating the support pads into a gap formed between the deflected bottom sheet and the bottom of the stack to support the stack while the bottom sheet is removed from the stack.

16. A method for handling a stack of sheets as set forth in claim 2 which includes:

positioning a selected one of the support pads oppositely a central portion of the stack of sheets, positioned another of the support pads oppositely a lateral portion of the stack of sheets, and moving the centrally positioned support pad into supporting position with the stack before moving the laterally positioned support pad into supporting position with the stack.

17. A method for handling a stack of sheets as set forth in claim 2 which includes:

positioning the support pads at selected intermediate and lateral portions of the stack leading edge in response to a die cut configuration of the leading edge of each sheet in the stack.

18. A method for handling a stack of sheets as set forth in claim 2 which includes:

actuating a first support pad into underlying engaging with a first portion of the stack leading edge, and after actuating the first support pad, actuating a second support pad into underlying engagement with a second portion of the stack leading edge.

19. Apparatus for supporting a stack of sheets as set forth in claim 3 which includes:

one of said arm members positioned oppositely an intermediate portion of the leading edge of the stacked sheets, a second of said arm members positioned oppositely a lateral portion of the leading edge of the stacked sheets, one of said cam mechanisms being connected to said drive shaft for moving said one arm member to position said pad to support the leading edge intermediate portion, a second of said cam mechanism being connected to said drive shaft for moving said second arm member to position said pad to support the leading edge lateral portion, and said one cam mechanism actuated faster than said second cam mechanism to move said one arm member pad into and out of supporting position with the leading edge intermediate portion before said second arm member pad moves into and out of supporting position with the leading edge lateral portion.

20. Apparatus for supporting a stack of sheets as set forth in claim 3 which includes:

a driven shaft positioned in adjacent, spaced parallel relation to said feed cylinder, a plurality of pull rolls nonrotatably mounted on said driven shaft to form a nip between said pull rolls and said feed cylinder to receive the bottom sheet extending from the stack, said pull rolls being rotated by said driven shaft in a direction opposite to the direction of rotation of said feed cylinder to frictionally engage with the feed cylinder the bottom sheet for removal from the stack, and means for adjusting the position of said pull rolls relative to said feed cylinder to ensure that said pull rolls engage the bottom sheet on the surface of said feed cylinder to pull the bottom sheet from the stack.

* * * * *